US007844203B2

(12) United States Patent
Takano et al.

(10) Patent No.: US 7,844,203 B2
(45) Date of Patent: Nov. 30, 2010

(54) DEVELOPMENT APPARATUS AND IMAGE FORMING APPARATUS USING THE SAME

(75) Inventors: Hidehiro Takano, Matsumoto (JP); Fuminori Yano, Manson Lakes (AU); Ken Ikuma, Suwa (JP); Koichi Kamijo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 897 days.

(21) Appl. No.: 11/622,378

(22) Filed: Jan. 11, 2007

(65) Prior Publication Data

US 2007/0160391 A1 Jul. 12, 2007

(30) Foreign Application Priority Data

Jan. 12, 2006 (JP) ..... 2006-004930
Oct. 16, 2006 (JP) ..... 2006-281114

(51) Int. Cl.
*G03G 15/10* (2006.01)

(52) U.S. Cl. ..... 399/237; 399/239; 399/249

(58) Field of Classification Search ..... 399/237, 399/239, 249, 348
See application file for complete search history.

(56) References Cited

U.S. PATENT DOCUMENTS 5,477,313 A * 12/1995 Kuramochi et al. ..... 399/239
6,687,477 B2 * 2/2004 Ichida et al. ..... 399/237
7,386,260 B2 * 6/2008 Oda et al. ..... 399/237
2001/0022901 A1 * 9/2001 Suetsugu ..... 399/57
2003/0016962 A1 * 1/2003 Teraoka et al. ..... 399/57
2003/0118377 A1 * 6/2003 Hirano ..... 399/284
2005/0047808 A1 * 3/2005 Yamamura ..... 399/44
2005/0047832 A1 * 3/2005 Hashimoto ..... 399/284
2005/0147423 A1 * 7/2005 Sasaki et al. ..... 399/45
2007/0128536 A1 * 6/2007 Miyakawa ..... 430/115

FOREIGN PATENT DOCUMENTS

JP 2004-012710 1/2004

* cited by examiner

*Primary Examiner*—David M Gray
*Assistant Examiner*—Rodney Bonnette
(74) *Attorney, Agent, or Firm*—DLA Piper LLP (US)

(57) ABSTRACT

A development apparatus includes an anilox roller for supplying liquid developer to a development roller and a supply roller arranged in a developer container and held in contact with the anilox roller to supply the liquid developer to the anilox roller. An AC voltage is applied to the supply roller, and a bias voltage is applied to the development roller. Liquid developer contained in grooves of undulations of an anilox pattern formed on a surface of the anilox roller is applied to the development roller.

19 Claims, 21 Drawing Sheets

DEVELOPMENT APPARATUS AND IMAGE FORMING APPARATUS USING THE SAME

CROSS REFERENCE TO RELATED APPLICATIONS

This Patent Application is based upon and claims the benefit of priority from the prior Japanese Patent Application No. 2006-004930, filed on Jan. 12, 2006 and Japanese Patent Application No. 2006-281114, filed on Oct. 16, 2006, the entire contents of which are incorporated herein by reference.

BACKGROUND OF THE INVENTION

1. Field of the Invention

The present invention relates to a development apparatus for developing the latent image formed on an image bearing member by means of a liquid developer and an image forming apparatus using such a development apparatus.

2. Description of the Related Art

Various wet type image forming apparatus adapted to develop a latent image by means of a highly viscous liquid developer formed by dispersing solid toner particles into a liquid solvent have been proposed to date. A developer to be used for such wet type image forming apparatus is prepared by suspending a solid ingredient (toner particles) into an electrically insulating and highly viscous organic solvent (carrier liquid) that is made of silicon oil, mineral oil or edible oil. The toner particles contained in the developer are very fine and show a particle diameter of about 1 μm. Due to the use of such fine toner particles, wet type image forming apparatus can provide high quality images if compared with dry type image forming apparatus that use powdery toner particles having a particle diameter of about 7 μm.

An anilox roller is used to supply such a liquid developer to a development roller. With regard to technologies relating to anilox rollers, Patent Document 1 (JP-A-2004-12710) describes a liquid development type electronic photography apparatus comprising a development roller and an anilox roller that are equipped with a temperature regulator for the purpose of supplying a thin layer of a liquid developer having a predetermined thickness from the anilox roller to the development roller. With such an arrangement, it is possible to supply thin layer of a liquid developer having a predetermined thickness to the development roller by constantly keeping the liquid toner temperature to a predetermined level.

SUMMARY OF THE INVENTION

However, when a highly viscous liquid developer is used as described above, toner particles are not uniformly dispersed in the liquid developer if viewed microscopically. Therefore, with a system for supplying a thin film of a liquid developer to a development roller from an anilox roller as described in the above cited Patent Document 1, the toner particles in the liquid developer sucked up in the individual grooves of the anilox roller may not be uniformly dispersed. Then, as a result, the developer on the development roller shows a minute uneven concentration of particulate toner, which by turn gives rise to an uneven image quality of the image transferred onto a recording medium.

An object of the present invention is to dissolve the above-identified problem. According to the present invention, this object is achieved by providing a development apparatus as defined in claim 1 that comprises: a development roller for developing a latent image formed on an image bearing member by means of a liquid developer; an anilox roller for supplying the liquid developer to the development roller; and a supply roller arranged in a developer container for containing the liquid developer and held in contact with the anilox roller to supply the liquid developer to the anilox roller, and an AC voltage being applied to the supply roller.

According to claim 2 of the present invention, there is also provided a development apparatus that comprises: a development roller for developing a latent image formed on an image bearing member by means of a liquid developer; an anilox roller for supplying the liquid developer to the development roller; and a regulation blade held in contact with the anilox roller to regulate the liquid developer on the anilox roller, and an AC voltage being applied to the regulation blade.

According to claim 3 of the present invention, in a development apparatus as defined in claim 1 or 2, the AC voltage is the sum of a DC voltage component and an AC voltage component.

According to claim 4 of the present invention, there is provided an image forming apparatus that comprises: a development roller for developing a latent image formed on an image bearing member by means of a liquid developer; an anilox roller for supplying the liquid developer to the development roller; and a supply roller arranged in a developer container for containing the liquid developer and held in contact with the anilox roller to supply the liquid developer to the anilox roller, and an AC voltage being applied to the supply roller.

According to claim 5 of the present invention, there is also provided an image forming apparatus that comprises: a development roller for developing a latent image formed on an image bearing member by means of a liquid developer; an anilox roller for supplying the liquid developer to the development roller; and a regulation blade held in contact with the anilox roller to regulate the liquid developer on the anilax roller, and an AC voltage being applied to the regulation blade.

According to claim 6 of the present invention, in an image forming apparatus as defined in claim 4 or 5, the AC voltage is the sum of a DC voltage component and an AC voltage component.

According to claim 7 of the present invention, there is also provided an image forming apparatus that comprises: a development roller for developing a latent image formed on an image bearing member by means of a liquid developer; an anilox roller for supplying the liquid developer to the development roller; a supply roller arranged in a developer container for containing the liquid developer and held in contact with the anilox roller to supply the liquid developer to the anilox roller; and a recycling mechanism for removing the excessive liquid developer from the image bearing member and/or the development roller and recycling the removed liquid developer to the developer container, and an AC voltage being applied to the supply roller.

According to claim 8 of the present invention, an image forming apparatus as defined in claim 7 further comprises an agitation tank having an agitation means for the excessive liquid developer removed from the image bearing member and the development roller.

According to claim 9 of the present invention, in an image forming apparatus as defined in claim 8, the agitation tank is equipped with a concentration sensing means for sensing the concentration of the developer.

According to claim 10 of the present invention, in an image forming apparatus as defined in claim 7, the supply roller and the anilox roller are driven in the same direction in a nip section.

According to claim 11 of the present invention, in an image forming apparatus as defined in claim 7, the AC voltage is the sum of a DC voltage component and an AC voltage component.

According to claim 12 of the present invention, there is also provided an image forming apparatus that comprises: a development roller for developing a latent image formed on an image bearing member by means of a liquid developer; an anilox roller for supplying the liquid developer to the development roller; a supply roller arranged in a developer container for containing the liquid developer and held in contact with the anilox roller to supply the liquid developer to the anilox roller; a regulation blade for regulating the liquid developer on the anilox roller; and a recycling mechanism for removing the excessive liquid developer from the image bearing member and the development roller and recycling the removed liquid developer to the developer container, and an AC voltage being applied to the regulation blade.

According to claim 13 of the present invention, an image forming apparatus as defined in claim 12 further comprises an agitation tank having an agitation means for the excessive liquid developer removed from the image bearing member and the development roller.

According to claim 14 of the present invention, in an image forming apparatus as defined in claim 13, the agitation tank is equipped with a concentration sensing means for sensing the concentration of the developer.

According to claim 15 of the present invention, in an image forming apparatus as defined in claim 12, the supply roller and the anilox roller are driven in the same direction in a nip section.

According to claim 16 of the present invention, in an image forming apparatus as defined in claim 12, the AC voltage is the sum of a DC voltage component and an AC voltage component.

Thus, in an image forming apparatus according to the present invention and having the above-described arrangement, the liquid developer sucked up in each of the grooves of the anilox roller contains the same quantity of toner particles if it comprises a mechanism for recycling the liquid developer. Then, the developer on the development roller does not show any minute uneven concentration of particulate toner so that the image ultimately in transferred onto a recording medium has an even and uniform image quality.

DETAILED DESCRIPTION OF THE PREFERRED EMBODIMENTS

Figure 1:
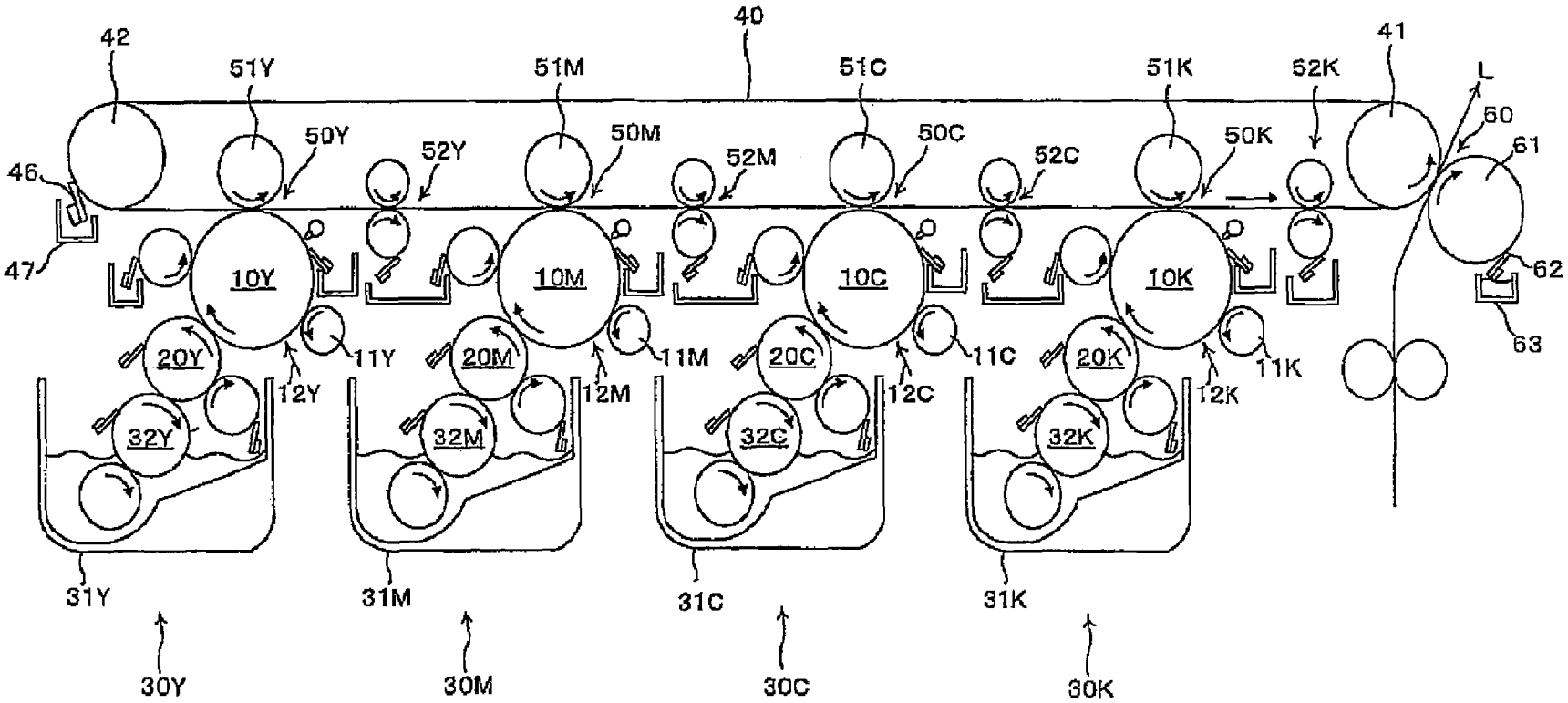
FIG. 1 is a schematic illustration of an embodiment of image forming apparatus according to the present invention, showing principal components thereof.

Now, preferred embodiments of the present invention will be described in greater detail by referring to the accompanying drawings. FIG. 1 is a schematic illustration of an embodiment of image forming apparatus according to the present invention, showing principal components thereof. While image forming sections of different colors are arranged substantially at the center of the image forming apparatus, development apparatus 30Y, 30M, 30C, 30K are arranged in a lower part of the image forming apparatus whereas an intermediate transfer member 40 and a secondary transfer section 60 are arranged in an upper part of the image forming apparatus.

The image forming sections include image bearing members 10Y, 10M, 10C, 10K, charging rollers 11Y, 11M, 11C, 11K and exposure units 12Y, 12M, 12C, 12K (not shown). The exposure units 12Y, 12M, 12C, 12K include an optical system having a semiconductor laser, a polygon mirror and an F-θ lens. Thus, the image bearing members 10Y, 10M, 10C, 10K are uniformly charged with electricity by the respective charging rollers 11Y, 11M, 11C, 11K and a laser beam is modulated according to the input video signal by the exposure units 12Y, 12M, 12C, 12K and irradiated onto the electrically charged image bearing members 10Y, 10N, 10C, 10K to form respective electrostatic images thereon.

The development apparatus 30Y, 30M, 30C, 30K respectively include development rollers 20Y, 20M, 20C, 20K, developer containers (reservoirs) 31Y, 31M, 31C, 31K containing liquid developers of yellow (Y), magenta (M), cyan (C) and black (K) and anilox rollers 32Y, 32M, 32C, 32K for supplying the liquid developers of the different colors from the developer containers 31Y, 31M, 31C, 31K to the development rollers 20Y, 20M, 20C, 20K so as to develop the electrostatic latent images formed on the image bearing members 10Y, 10M, 10C, 10K by means of the liquid developers of the different colors.

The intermediate transfer member 40 is an endless belt that is wound between a drive roller 41 and a tension roller 42. It is driven to rotate by the drive roller 41, contacting the image bearing members 10Y, 10M, 10C, 10K at respective primary transfer sections 50Y, 50M, 50C, 50K. Primary transfer sections 50Y, 50M, 50C, 50K respectively include the image bearing members 10Y, 10M, 10C, 10K and the primary transfer rollers 51Y, 51M, 51C, 51K, which are arranged opposite to the respective image bearing members 10Y, 10M, 10C, 10K with the intermediate transfer member 40 interposed between them. Thus, the developed toner images of the different colors on the image bearing members 10Y, 10M, 10C, 10K are sequentially transferred onto the intermediate transfer member 40 at the positions contacting the image bearing members 10Y, 10M, 10C, 10K so as to be laid one on the other in order to produce a full color toner image.

The secondary transfer unit 60 includes a secondary transfer roller 61 arranged opposite to the belt drive roller 41 with the intermediate transfer member 40 interposed between them as well as a cleaning apparatus that by turn includes a secondary transfer roller cleaning blade 62 and a developer collecting section 63. The monochromatic toner image or the full color toner image formed on the intermediate transfer member 40 is transferred onto a recording medium, which may be a sheet of paper, film or cloth, conveyed and brought in along the sheet member conveying route L at the transfer position where the secondary transfer roller 61 is arranged.

A fixing unit (not shown) is arranged at a downstream position of the sheet member conveying route L to fix the monochromatic toner image or the full color toner image, whichever appropriate, transferred onto the recording medium such a sheet of paper by fusion.

The tension roller 42 tensions the intermediate transfer member 40 with the belt drive roller 41. A cleaning apparatus including an intermediate transfer member cleaning blade 46 and a developer collecting section 47 is arranged at the position where the intermediate transfer member 40 is tensioned by the tension roller 42.

Figure 2:
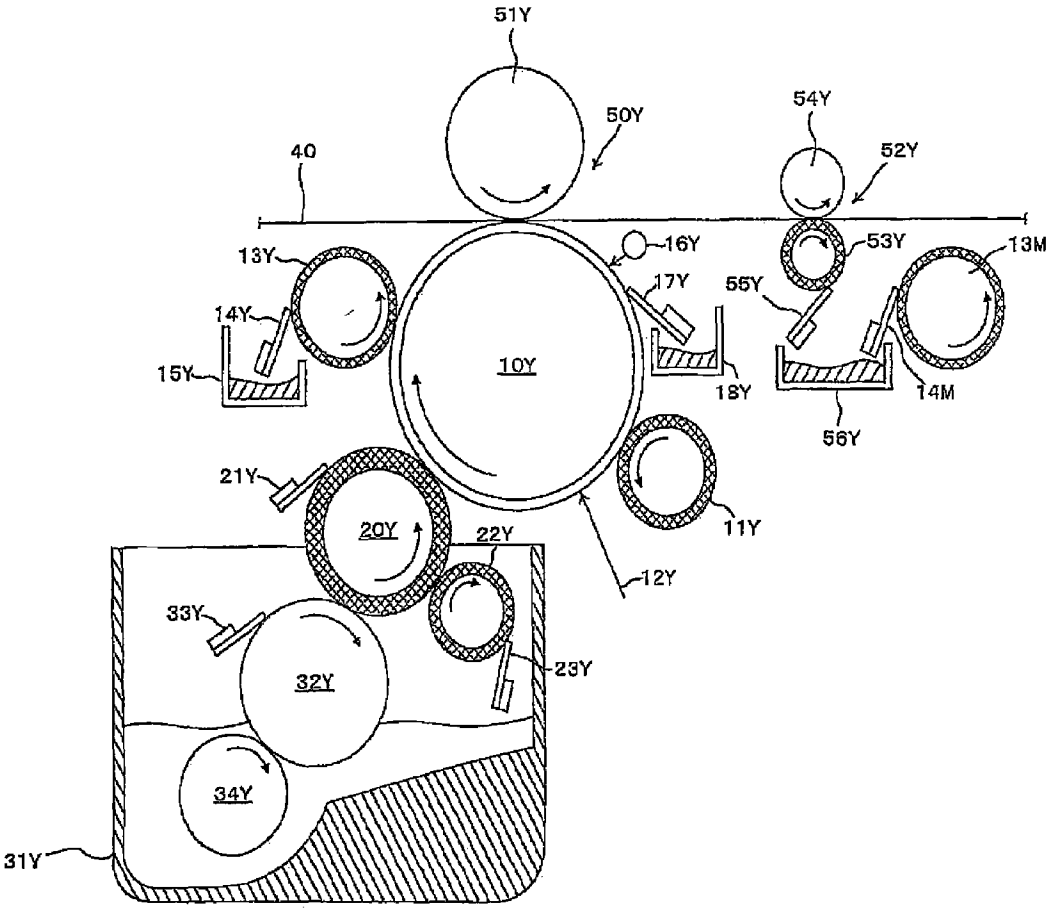
FIG. 2 is a schematic cross sectional view of principal components of one of the image forming sections and the corresponding one of the development apparatus.
Figure 3:
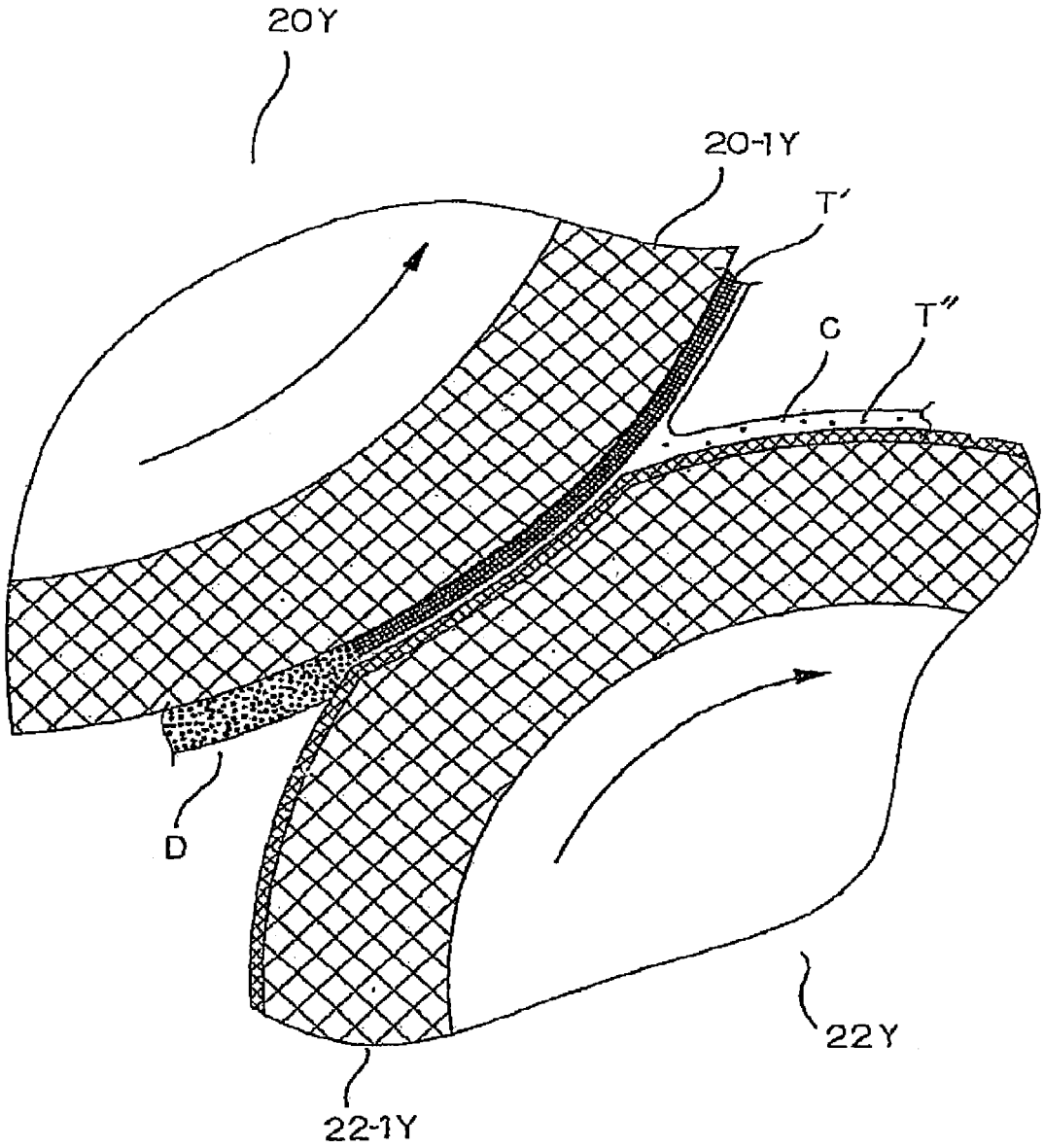
FIG. 3 is a schematic illustration of the compaction produced by a toner compressing roller 22Y.
Figure 4:
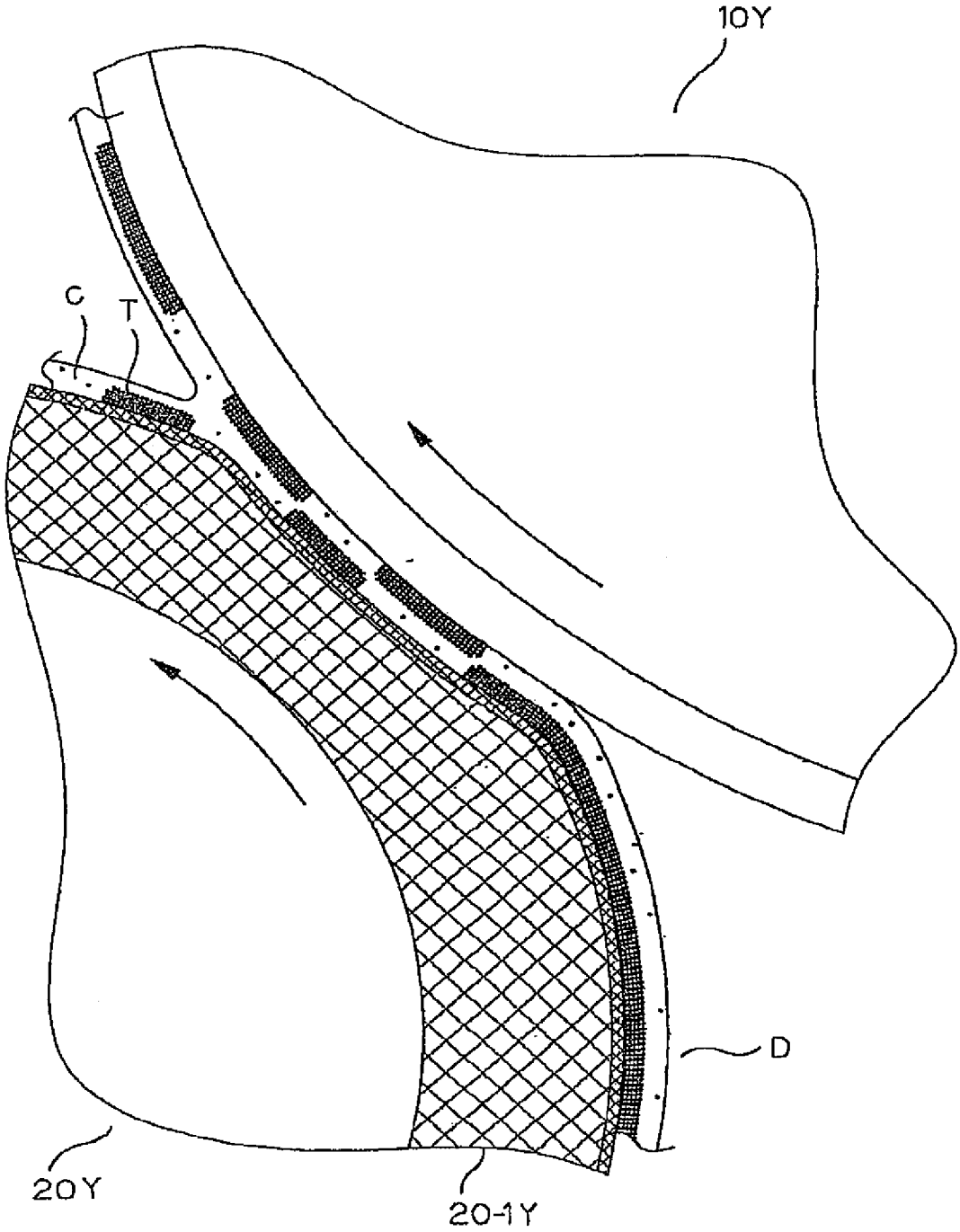
FIG. 4 is a schematic illustration of the development operation of a development roller 20Y.
Figure 5:
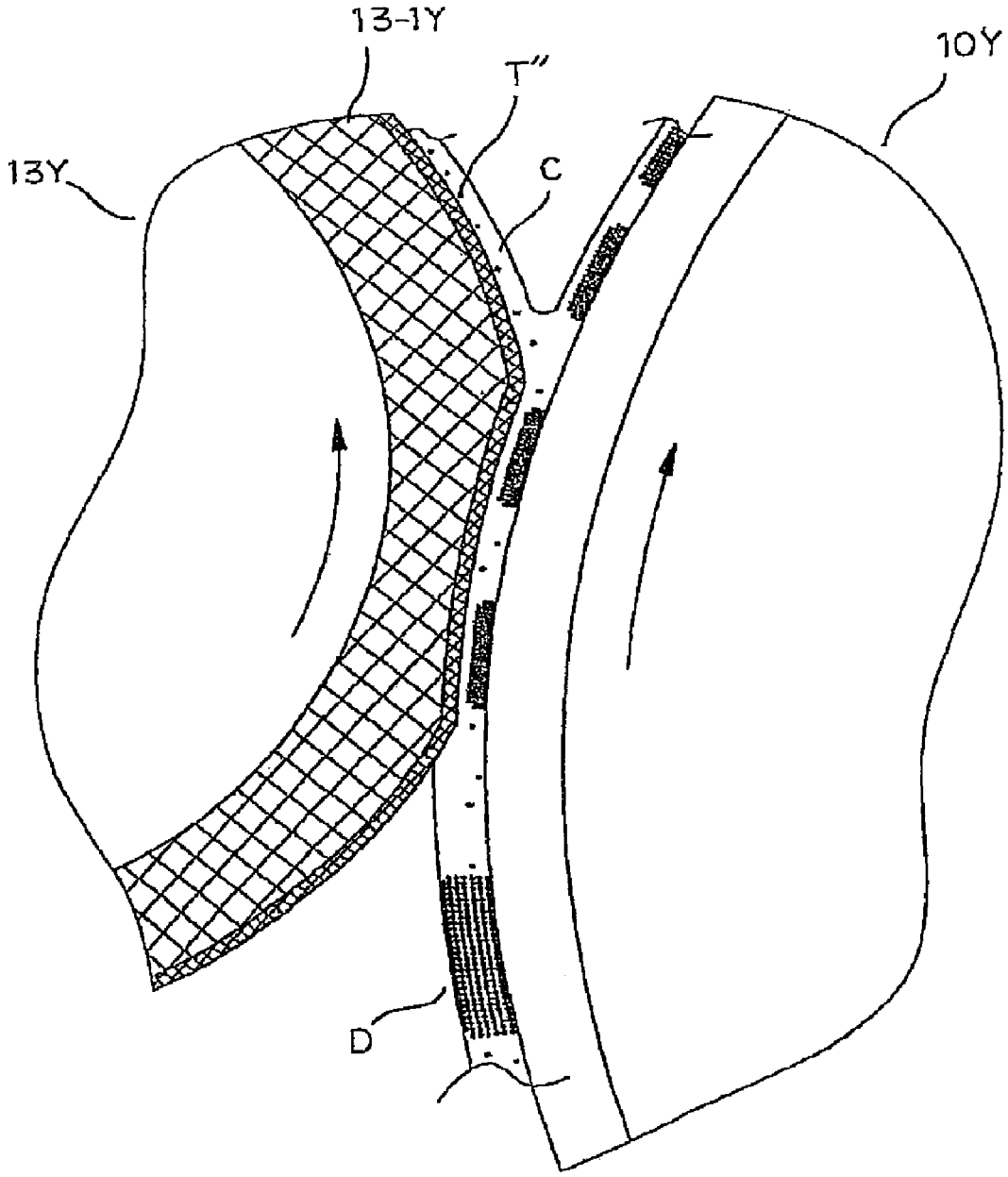
FIG. 5 is a schematic illustration of the squeezing effect of an image bearing member squeezing roller 13Y.
Figure 6:
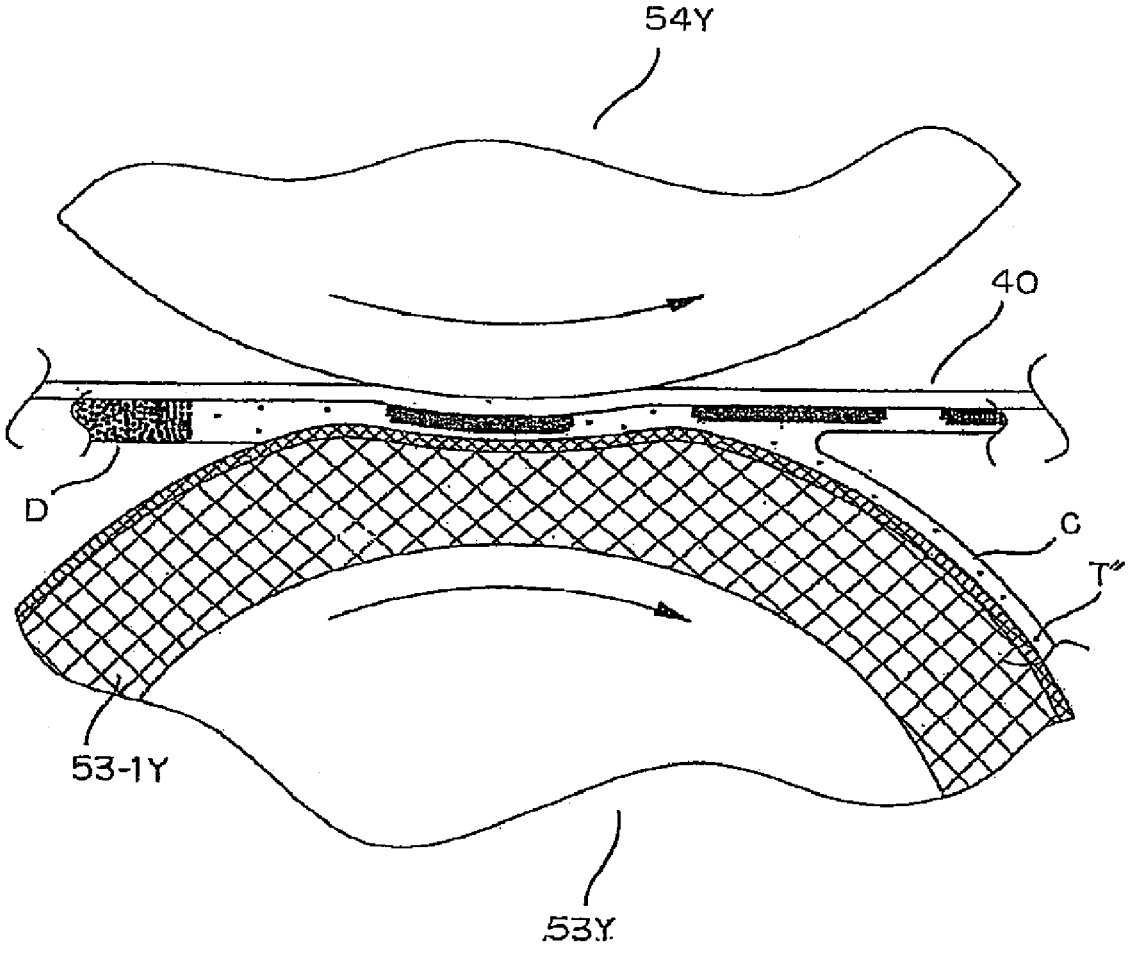
FIG. 6 is a schematic illustration of the squeezing effect of an intermediate transfer member squeezing apparatus 52Y.

Now, the image forming sections and the development apparatus will be described below. FIG. 2 is a schematic cross sectional view of principal components of one of the image forming sections and the corresponding one of the development apparatus. FIG. 3 is a schematic illustration of the compaction produced by a toner compressing roller 22Y. FIG. 4 is a schematic illustration of the development operation of a development roller 20Y. FIG. 5 is a schematic illustration of the squeezing effect of an image bearing member squeezing roller 13Y. FIG. 6 is a schematic illustration of the squeezing effect of an intermediate transfer member squeezing apparatus 52Y. Since the image forming sections and the development apparatus of the different colors have the same configuration, only the image forming section and the development apparatus of the yellow color (Y) will be described below.

In the image forming section, a cleaning apparatus including a latent image eraser 16Y, an image bearing member cleaning blade 17Y and a developer collecting section 18Y, a charging roller 11Y, an exposure unit 12Y, a development roller 20Y that belongs to the development apparatus 30Y and a cleaning apparatus including an image bearing member squeezing roller 13Y and an image bearing member squeezing roller cleaning blade 14Y and a developer collecting section 15Y that are annexes to the roller 13Y are arranged along the outer periphery of the image bearing member 10Y in the mentioned order in the sense of rotation thereof. In the development apparatus 30Y, a cleaning blade 21Y, an anilox roller 32Y and a toner compressing roller 22Y are arranged along the outer periphery of the development roller 20Y. A carrier quantity regulation blade 23Y is arranged along the outer periphery of the toner compressing roller 22Y. The liquid developer container 31Y contains therein a liquid developer supply roller 34Y and the anilox roller 32Y. The primary transfer roller 51Y of the primary transfer section is arranged along the intermediate transfer member 40 at a position facing the image bearing member 10Y and an intermediate transfer member squeezing apparatus 52Y that includes an intermediate transfer member squeezing roller 53Y, a backup roller 54Y, an intermediate transfer member squeezing roller cleaning blade 55Y and a developer collecting section 56Y is arranged downstream relative to the image bearing member 10Y.

The image bearing member 10Y is a photosensitive cylindrical drum having a width greater than that of the development roller 20Y, which is about 320 mm, and carrying a photosensitive layer formed on the outer peripheral surface thereof. It is typically driven to rotate clockwise as shown in FIG. 2. The photosensitive layer of the image bearing member 10 is an organic image bearing member or an amorphous silicon image bearing member. The charging roller 11Y is arranged at the upstream side in the sense of rotation of the image bearing member 10Y relative to the nip section formed by the image bearing member 10Y and the development roller 20Y. A bias voltage showing the polarity same as the toner charging polarity is applied to the charging roller 11Y from a power supply apparatus (not shown) to charge the image bearing member 10Y with electricity. The exposure unit 12Y is adapted to irradiate a laser beam onto the image bearing member 10Y that is electrically charged by the charging roller 11Y to form a latent image on the image bearing member 10Y at a position downstream relative to the charging roller 11Y in the sense of rotation of the image bearing member 10Y.

The development apparatus 30Y includes the toner compressing roller 22Y, the developer container 31Y for containing the liquid developer where toner is dispersed in carrier liquid by approximately 20 wt %, a development roller 20Y for bearing the liquid developer, the anilox roller 32Y, the regulation blade 33Y and the supply roller 34Y being adapted to agitate the liquid developer to maintain it in a uniformly dispersed state and supply it to the development roller 20Y, the toner compressing roller 22Y for produce a compacted state for the liquid developer borne on the development roller 20Y and a development roller cleaning blade 21Y for cleaning the development roller 20Y.

The liquid developer contained in the developer container 31Y is not the popular low concentration (about 1 to 2 wt %) and low viscosity volatile liquid developer that contains Isopar (tradename: available from Exxon) as carrier and is volatile at room temperature but a high concentration and high viscosity is non-volatile liquid developer that is non-volatile at room temperature. More specifically, the liquid developer to be used for the purpose of the present invention is a high viscosity (about 30 to 10,000 mPa·s) liquid developer prepared by adding solid particles having an average particle diameter of 1 μm obtained by dispersing a coloring agent such as pigment into thermoplastic resin to a liquid solvent such as an organic solvent, silicon oil, mineral oil or edible oil along with a dispersant to make the toner solid component show a concentration of about 20%.

Figure 7:
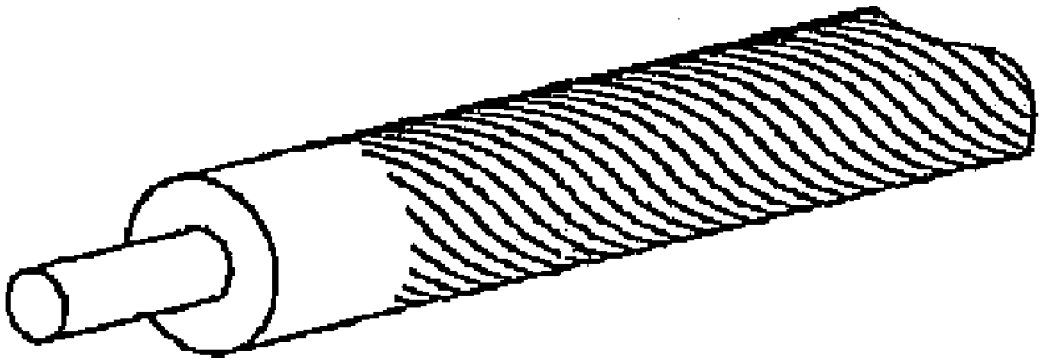
FIG. 7 is a schematic illustration of an anilox roller, showing the profile thereof.

The anilox roller 32Y is a cylindrical member having an undulated surface produced by helical fine grooves formed regularly on the surface so that the surface may bear the developer without difficulty as shown in FIG. 7. The grooves are arranged at a pitch of about 130 μm and show a depth of arrangement of about 30 μm. The liquid developer is supplied from the developer container 31Y to the development roller 20Y by the anilox roller 32Y. From the viewpoint of maximizing the effect of the AC bias voltage, which will be described in greater detail hereinafter, it is desirable that the anilox roller 32Y and the supply roller 34Y are driven to rotate in the same sense of rotation and contact with each other. Additionally, at least the surface of the supply roller 34Y is prepared by using an elastic member and desirably shows a surface resistance of about $10^5$ O·cm.

The regulation blade 33Y is an elastic blade formed by covering the surface with an elastic member. In other words, it includes a rubber section typically made of urethane rubber and adapted to contact the surface of the anilox roller 32Y and a metal plate supporting the rubber section. It is adapted to limit and regulate the film thickness and the quantity of the liquid developer borne and conveyed by the anilox roller 32Y and also regulate the quantity of the liquid developer supplied to the development roller 20Y. From the viewpoint of maximizing the effect of the AC bias voltage, which will be described in greater detail hereinafter, it is desirable that the regulation blade 33Y contacts the anilox roller 32Y by trailing contact and limits the film thickness by the surface that contacts the anilox roller 32Y. The surface resistance of the elastic blade of the regulation blade 33Y is desirably about $10^5$ O·cm.

The development roller 20Y is a cylindrical member having a width of about 320 mm and adapted to rotate counterclockwise around the rotary shaft as shown in FIG. 2. The development roller 20Y is formed by arranging an elastic layer of polyurethane rubber, silicon rubber or NBR around the outer periphery of a metal inner core made of a metal such as iron. The development roller cleaning blade 21Y is typically made of rubber. It is adapted to contact the surface of the development roller 20Y and arranged at the downstream side relative to the development nip section where the development roller 20Y contacts the image bearing member 10Y in the sense of rotation of the development roller 20Y so as to remove the liquid developer remaining on the development roller 20Y by scraping off.

The toner compressing roller 22Y is a cylindrical member. As shown in FIG. 3 and similar to the development roller 20Y, the roller 22Y is formed by arranging an elastic member 22-1Y as cover layer. It shows a structure having a metal roller base member and a resin layer or a rubber layer arranged on the surface of the base member. For instance, as shown in FIG. 2, it is driven to rotate clockwise in the sense opposite to the sense of rotation of the development roller 20Y. The toner compressing roller 22Y has a means for raising the charging bias voltage of the surface of the development roller 20Y. Thus, the developer brought in by the development roller 20Y applies an electric field toward the development roller 20Y from the side of the toner compressing roller 22Y at the toner compressing position where the toner compressing roller 22Y contacts to form a nip section and slides as shown in FIGS. 2 and 3. The roller that operates as toner compressing and electric field applying means shown in FIG. 2 may be replaced by a corona discharger for corona discharges.

As shown in FIG. 3, the toner compressing roller 22Y moves the toner T that is uniformly dispersed in the carrier c to the side of the development roller 20Y to produce a so-called compacted toner condition T'. As the toner compressing roller 22Y rotates in the sense of the arrow in FIG. 3, bearing part of the carrier C and some toner T" that is not compacted, the carrier C and the toner T" are scraped off and removed by the carrier quantity regulation blade 23Y so that they are merged with the developer in the reservoir 31Y for recycling. The carrier quantity regulation blade 23Y will be described later. On the other hand, the developer D borne by the developer roller 20Y and held in the compacted toner condition develops the latent image on the image bearing member 10Y at the development nip section where the development roller 20Y contacts the image bearing member 10Y as shown in FIG. 4 as a desired electric field is applied to it. The developer D that is not consumed for the development is scraped off by the developer roller cleaning blade 21Y and merged with the developer in the reservoir 31Y for recycling. The carrier and the toner that are merged are not in the color mixing condition.

The image bearing member squeezing apparatus is arranged opposite to the image bearing member 10Y and below the developer 20Y to collect the excessive developer from the developed toner image on the image bearing member 10Y. As shown in FIGS. 2 and 5, it includes an image bearing member squeezing roller 13Y that is an elastic roller member having a surface elastic member 13-1Y and held in sliding contact with the image bearing member 10Y and a cleaning blade 14Y slidably pressed against the image bearing member squeezing roller 13Y to clean the surface of the latter. As shown in FIG. 5, it operates to collect the excessive carrier C and the unnecessary fogging toner T" from the developer D used for developing the latent image on the image bearing member 10Y in order to raise the toner particle ratio in the developed visible image. The collecting capacity to collect the excessive carrier C of the image bearing member squeezing apparatus can be selected by defining the sense of rotation of the image bearing member squeezing roller 13Y and the difference between the peripheral speed of the surface of the image bearing member 10Y and that of the surface of the image bearing member squeezing roller 13Y. The capacity is raised when the image bearing member squeezing roller 13Y is driven to rotate in the sense opposite to the sense of rotation of the image bearing member 10Y and also when the difference of peripheral speed is increased. A synergetic effect can be obtained by appropriately selecting the sense of rotation and the peripheral speed difference.

In this embodiment, the image bearing member squeezing roller 13Y is driven to rotate with the image bearing member 11Y in the same sense of rotation substantially at the same peripheral speed as shown in FIG. 5 in order to collect the excessive carrier C that is about 5 to 10 wt % of the developer D consumed for developing the latent image on the image bearing member 10Y. With this arrangement, it is possible to reduce the load of driving the two rollers and minimize the effects of external turbulences on the developed visible toner image on the image bearing member 10Y. The excessive carrier C and the unnecessary fogging toner T" collected by the image bearing member squeezing roller 13Y is collected in the developer collecting section 15Y from the image bearing member squeezing roller 13Y and pooled there by the operation of the cleaning blade 14Y. Note that, since the excessive carrier C and the fogging toner T" are collected from the dedicated and isolated image bearing member 10Y, no color mixing phenomenon appears throughout the image forming apparatus.

The primary transfer section 50Y transfers the developer image developed on the image bearing member 10Y onto the intermediate transfer member 40 by means of the primary transfer roller 51Y. The image bearing member 10Y and the intermediate transfer member 40 are configured to be driven to move at the same speed to reduce the load of driving the primary transfer roller 51Y to rotate and the intermediate transfer member 40 to move and this configuration minimizes the effect of external turbulences to the visible toner image on the image bearing member 10Y. While no color mixing phenomenon appears at the primary transfer section 50Y that is the transfer section for the first color, other toner images are laid on the toner image from the primary transfer section 50Y in the second and subsequent primary transfer sections. Then, a so-called inverse transfer phenomenon appears and toner is moved from the intermediate transfer member 40 to the image bearing members 10 (M, C, K). Thus, the inversely transferred toner and the residual toner left after the image transfer operations are mixed and borne by the image bearing members 10 (M, C, K) to move until they are collected from the image bearing members by the cleaning blades 17 (M, C, K) and pooled.

The intermediate transfer member squeezing apparatus 52Y is arranged at the downstream side of the primary transfer section 50Y to remove the excessive carrier liquid from the surface of the intermediate transfer member 40 to raise the toner particle ratio in the developed visible image. It is provided as a means for removing any excessive carrier liquid from the intermediate transfer member 40 when the quantity of carrier liquid in the developer (the toner dispersed in the carrier) transferred onto the intermediate transfer member 40 at the primary transfer section 50Y is short of about 40 wt % to 60 wt % in a dispersed condition of the liquid developer that is required to realize a desired secondary transfer function and the fixing function when the image is transferred onto a sheet by secondary transfer and proceeded to the fixing process to ultimately complete the operation. Like the image bearing member squeezing apparatus, the intermediate transfer member squeezing apparatus 52Y includes an intermediate transfer member squeezing roller 53Y having a surface elastic member and held in sliding contact with the image bearing member 40, a backup roller 54Y arranged opposite to the intermediate transfer member squeezing roller 53Y with the image bearing member 40 interposed between them, a cleaning blade 55Y slidably pressed against the intermediate transfer member squeezing roller 53Y to clean the surface of the latter and a developer collecting section 56Y so as to operate to collect the excessive carrier C and the unnecessary fogging toner T" from the developer D transferred on the intermediate transfer member 40 in the primary transfer operation as shown in FIG. 6. The developer collecting section 56Y also operates as a carrier liquid collecting mechanism for collecting the carrier liquid collected by the magenta image bearing member squeezing roller cleaning blade 14 arranged at the downstream side thereof.

The capacity for collecting excessive carrier liquid can be selected by appropriately defining the sense of rotation of the intermediate transfer member squeezing roller 53Y and the difference between the moving speed of the intermediate transfer member 40 and the speed of the surface of the intermediate transfer member squeezing roller 53Y. The capacity is raised when the intermediate transfer member squeezing roller 53Y is driven to rotate in the sense opposite to the moving direction of the intermediate transfer member 40 and also when the difference of peripheral speed is increased. A synergetic effect can be obtained by appropriately selecting the sense of rotation and the peripheral speed difference. In this embodiment, the intermediate transfer member squeezing roller 53Y is driven to rotate with the intermediate transfer member 40 in the same sense of rotation substantially at the same peripheral speed in order to collect the excessive carrier liquid and the fogging toner that are about 5 to 10 wt % of the developer D transferred onto the intermediate transfer member 40 in the primary transfer. With this arrangement, it is possible to reduce the load of driving the two members and minimize the effects of external turbulences of the intermediate transfer member 40 to the developed toner image.

While no color mixing phenomenon appears at the intermediate transfer member squeezing position of the first color because the first intermediate transfer member squeezing operation takes place there, other toner images of the second and subsequent colors are laid on the toner image of the first color produced as a result of primary transfer so that the toner moved from the intermediate transfer member 40 to the intermediate transfer member squeezing roller 53Y is mixed in terms of color and borne by the intermediate transfer member squeezing roller 53Y with the excessive carrier liquid so as to be moved, collected and pooled by the operation of the cleaning blades. If both the squeezing capacity of the image bearing members 40 at the upstream side primary transfer positions of the above-described intermediate transfer member squeezing process and the squeezing capacity of the image bearing member squeezing roller 53Y are sufficient, iv is not necessary to arrange an intermediate transfer member squeezing apparatus at the downstream side of each of the primary transfer processes.

Now, the operation of the image forming apparatus according to the embodiment of the present invention will be described below. Only the image forming section of the yellow color (Y) of the development apparatus 30Y will be described below out of the four image forming sections for the above-described reason.

The toner particles in the liquid developer in the developer container 31Y have a positive electric charge and the liquid developer is agitated by the supply roller 34Y and sucked up from the developer container 31Y as the anilox roller 32Y is driven to rotate. At this time, if a bias voltage of +300 V, for instance, is applied to the development roller 20Y, the same DC bias voltage of +300 V is also applied to the anilox roller 32Y. The toner particles in the liquid developer are subjected to micro-oscillations by applying both a DC bias voltage of +300 V and an AC voltage of 0 to 600 V of a frequency of 1,500 Hz simultaneously to the supply roller 34Y. While the AC bias voltage may well show a rectangular waveform or a sinusoidal waveform, the use of a rectangular waveform is preferable from the viewpoint of effectively achieving micro-oscillations of toner particles.

Figure 8:
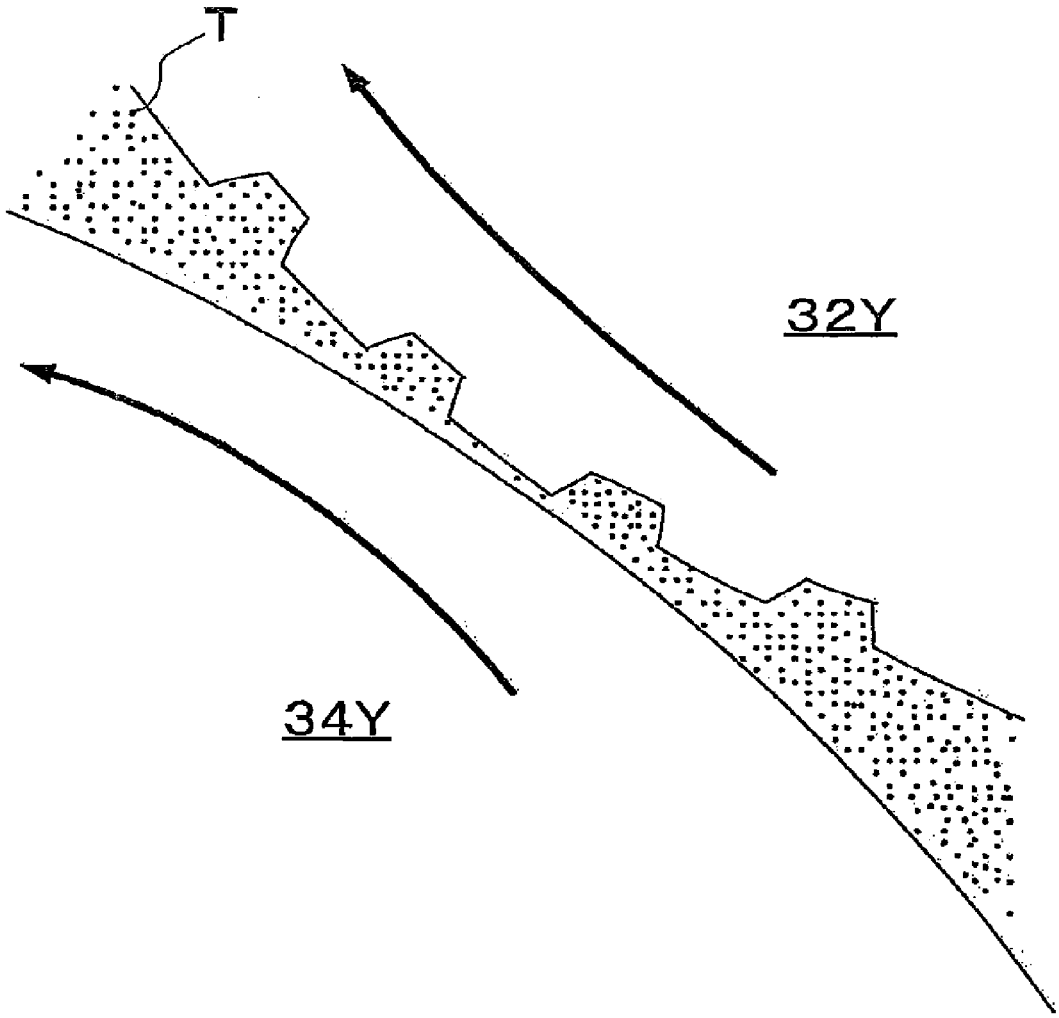
FIG. 8 is an enlarged schematic illustration of a contact area of an anilox roller 32Y and a supply roller 34Y.
Figure 9:
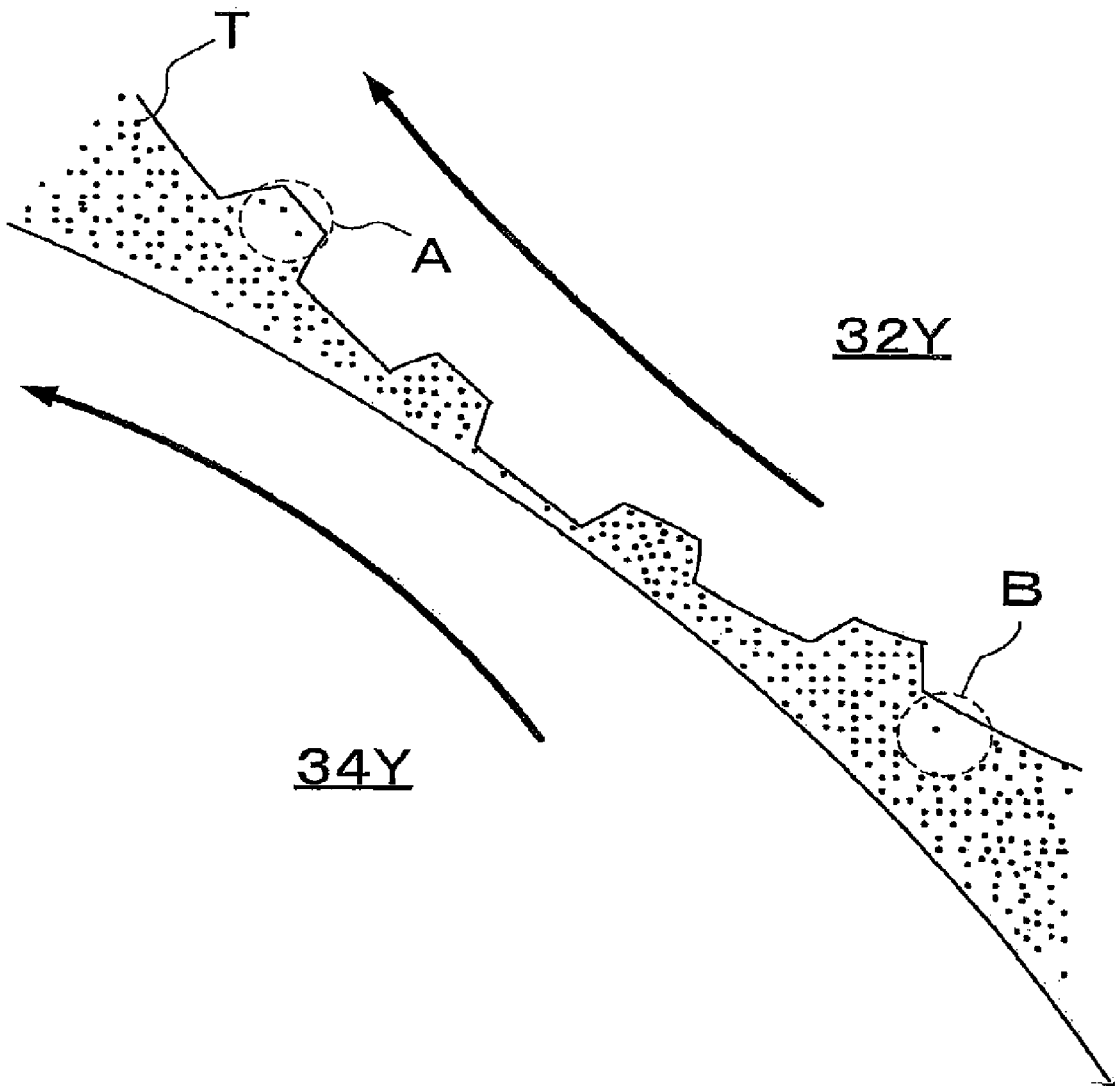
FIG. 9 is another enlarged schematic illustration of the contact area of the anilox roller 32Y and the supply roller 34Y.

The toner particles in the liquid developer are uniformly dispersed as an AC voltage is applied to the supply roller 34Y to subject the toner particles to micro-oscillations. FIGS. 8 and 9 are enlarged schematic illustrations of the contact area of the anilox roller 32Y and the supply roller 34Y of this embodiment. In FIGS. 8 and 9, T denotes toner particles. FIG. 8 is a schematic illustration of the contact area when an AC voltage is applied to the supply roller 34Y, whereas FIG. 9 is a schematic illustration of the contact area when no AC voltage is applied to the supply roller 34Y. As seen from FIG. 8, the toner particles in the liquid developer that are found between the anilox roller 32Y and the supply roller 34Y are uniformly dispersed when an AC voltage is applied to the supply roller 34Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, toner particles are unevenly dispersed in the liquid developer and areas that are practically free from toner particles such as those indicated by A and B in FIG. 9 locally appear in the liquid developer between the anilox roller 32Y and the supply roller 34Y when no AC voltage is applied to the supply roller 34Y. Then, as a result, minute uneven concentrations appear on the image developed on the development roller.

In the image forming apparatus of this embodiment that utilizes a developer where toner is dispersed in carrier liquid, the developer is prepared by dispersing toner into the carrier liquid by about 20 wt % relative to about 80 wt % of the carrier liquid. After the various image forming processes, about 45% in the case of coat paper or some other glossy paper, about 55% in the case of ordinary paper and about 60% in the case of rough paper such as recycled paper where fibers are arranged coarsely are selected as respective target values for the toner weight ratio (solid content ratio) at the so-called secondary transfer position immediately before the operation of transferring the image on a sheet of paper or the like takes place as secondary transfer. In the initial stages, toner is dispersed in the carrier liquid to show a toner weight ratio of about 20% in the developer contained in the developer container 31Y. However, toner consumption rate is high when the so-called image duty is high in the process of developing the latent image on the image bearing member 10Y, whereas the toner consumption rate is low when the so-called image duty is low. In other words, the toner weight ratio of the developer contained in the developer container 31Y changes incessantly as the latent image on the image bearing member 10Y is developed so that it is necessary to constantly monitor the change and maintain the dispersed condition of toner to hold the toner weight ratio to about 20 wt %.

For this purpose, although not shown, the developer container 31Y is equipped with a transmission type photo-sensor for sensing the dispersed toner weight ratio, a torque sensing means for sensing the agitation torque for agitating the developer or a reflection type photo-sensor for sensing the liquid surface of the developer in the developer container 31Y so that, when the dispersed toner weight ratio falls below the above-described level in a predetermined quantity of developer, developer containing toner to a high concentration, or a toner weight ratio of about 35 to 55%, in a dispersed state is supplied from a developer cartridge by a prescribed quantity to maintain the toner weight ratio to about 20%. When, to the contrary, the toner weight ratio rises above the above-described level in a predetermined quantity of developer, carrier liquid is supplied from a carrier cartridge also to maintain the toner weight ratio to about 20%. At the same time, the developer in the developer container 31Y is agitated to uniformly disperse the toner in the developer.

The regulation blade 33Y is held in contact with the surface of the anilox roller 32Y to scrape off the excessive liquid developer, while leaving the liquid developer in the grooves of the undulations of the anilox pattern formed on the surface of the anilox roller 32Y, in order to regulate the quantity of liquid developer supplied to the development roller 20Y. With this arrangement for regulation, the film thickness of the film layer of the liquid developer applied to the development roller 20Y is constantly held to about 6 μm. The liquid developer scraped off by the regulation blade 33Y is made to fall into the developer container 31Y by its own gravity, while the liquid developer not scraped off by the regulation blade 33Y is contained in the grooves of the undulations on the surface of the anilox roller 32Y and then applied to the surface of the development roller 20Y as the anilox roller 32Y is held in contact with and pressed against the development roller 20Y.

The surface of the development roller 20Y to which the liquid developer is applied by the anilox roller 32Y then contacts the toner compressing roller 22Y at a position downstream relative to the nip section formed by itself and the surface of the anilox roller 32Y. A bias voltage of about +300 V is applied to the development roller 20Y and a bias voltage higher than the bias voltage being applied to the development roller 20Y and showing a polarity same as the polarity of the electric charge of the toner is applied to the toner compressing roller 22Y. For example, a bias voltage of about +600 V may be applied to the toner compressing roller 22Y. Then, the toner particles in the liquid developer on the development roller 20Y are moved to the side of the development roller 20Y when they pass the nip section formed by the development roller 20Y and the toner compressing roller 22Y as shown in FIG. 3. As a result, the developer moved to the development roller 20Y shows a filmy state where toner particles are loosely bonded so that toner particles can move quickly from the development roller 20Y to the image bearing member 11Y to consequently raise the image density of the image developed on the image bearing member 10Y.

The image bearing member 10Y is made of amorphous silicon. The surface of the image bearing member 10Y is charged with electricity by the charging roller 11Y to about +600 V at a position upstream relative to the nip section and the development roller 20Y and subsequently a latent image is formed by the exposure unit 12Y in such a way that the image area shows an electric potential of +25V. At the development nip section formed by the development roller 20Y and the image bearing member 10Y, toner particles T are selectively moved onto the image bearing member 10Y as shown in FIG. 4 according to the electric field produced by the bias voltage of +300 V being applied to the development roller 20Y and the latent image on the image bearing member 10Y (image area: +25 V, non-image area: +600 V) so that a toner image is formed on the image bearing member 10Y. Since the carrier liquid C is not influenced by the electric field, it is separated into two parts at the exit of the development nip section formed by the development roller 20Y and the image bearing member 10Y so as to adhere to both the development roller 20Y and the image bearing member 10Y. The image bearing member 10Y that passes the development nip section then passes the image bearing member squeezing roller 13Y, where the excessive carrier liquid C is removed as shown in FIG. 5 to raise the toner particle content ratio in the visible image.

Then, the image bearing member 10Y passes the nip section formed by the intermediate transfer member 40 and itself at the primary transfer section 50Y, where the visible toner image is transferred onto the intermediate transfer member 40 in a primary transfer operation. As voltage of about −200 V is applied to the primary transfer roller 51Y with the polarity opposite to that of the electric charge of toner particles, the toner is transferred from the image bearing member 10Y onto the intermediate transfer member 40 as a result of a primary transfer operation to leave only the carrier liquid on the image bearing member 10Y. The electrostatic latent image on the image bearing member 10Y is removed by the latent image eraser 16Y, that is typically formed by using an electric lamp, at the downstream side of the image bearing member 10Y relative to the primary transfer section in the sense of rotation thereof and the carrier liquid left on the image bearing member 10Y is scraped off by the image bearing member cleaning blade 17Y and collected by the developer collecting section 18Y.

The toner image transferred onto the intermediate transfer member 40 at the primary transfer section 50Y as a result of a primary transfer operation passes the intermediate transfer member squeezing apparatus 52Y, which scrapes off the excessive carrier liquid on the intermediate transfer member 40. A voltage of +400 V is applied to the intermediate transfer member squeezing roller 53Y of the intermediate transfer member squeezing apparatus 52Y and a voltage of +200 V is applied to the intermediate transfer member squeezing backup roller 54Y to generate an electric field that presses toner particles against the intermediate transfer member 40. Therefore, as a result, no toner particles are collected by the intermediate transfer member squeezing roller 53Y as shown in FIG. 6 and only the carrier liquid that is not affected by the electric field is isolated between the intermediate transfer member 40 and the intermediate transfer member squeezing roller 53Y and collected.

The toner image on the intermediate transfer member 40 then proceeds to the secondary transfer unit 60 and moves into the nip section formed by the intermediate transfer member 40 and the secondary transfer roller 61. The nip section is made to show a width of 3 mm. In the secondary transfer unit 60, voltages of −1,200 V and +200 V are applied respectively to the secondary transfer roller 61 and the belt drive roller 41 to transfer the toner image on the intermediate transfer member 40 onto a recording medium, which may typically be a sheet of paper.

After passing the secondary transfer unit 60, the intermediate transfer member 40 proceeds to a winding part of the tension roller 42, where the surface of the intermediate transfer member 40 is cleaned by the intermediate transfer member cleaning blade 46, and then further to the primary transfer section 50 once again.

Now, the squeezing feature of the secondary transfer roller 61 will be described below. The sheet member is supplied to the secondary transfer position at the timing when the toner image formed by laying toner images of different colors arrives at the secondary transfer position and the toner image is transferred onto the sheet member in a secondary transfer process. Then, the sheet member is made to proceed to the fixing process (not shown) to ultimately complete the operation of forming an image on the sheet member. When trouble such as a jammed sheet member takes place, the toner image is transferred onto the secondary transfer roller 61 without the sheet member laid on the secondary transfer roller 61 to consequently smear the rear surface of the following sheet member. In this embodiment, the secondary transfer roller 61 is formed by using an elastic roller equipped with an elastic member arranged on the surface thereof so as to follow the surface profile of a sheet member if the surface of the sheet member is fibrous and not smooth and improve the secondary transfer performance just like the elastic belt of the intermediate transfer member 40 for carrying the toner images formed on a plurality of photosensitive members and sequentially transferred onto and laid on it one on the other before the toner images are collectively transferred onto a sheet member in a secondary transfer operation. The secondary transfer roller cleaning blade 62 is provided as a means for removing the developer (containing toner dispersed in carrier liquid) transferred onto the secondary transfer roller 61 and the developer collected from the secondary transfer roller 61 is pooled. Note that the pooled developer shows a color mixing phenomenon and can contain foreign objects such as paper dust.

Now, the cleaning apparatus of the intermediate transfer member 40 will be described below. When trouble such as a jammed sheet member takes place, not all the toner image is transferred onto the secondary transfer roller 61 and collected but partly left on the intermediate transfer member 40. In the ordinary secondary transfer process, the toner image on the intermediate transfer member 40 is not transferred onto a sheet member by 100%. In other words, the toner image is partly left on the intermediate transfer member 40 by several percents after the secondary transfer process. The toner of either of the above-listed two unnecessary toner images is collected by the intermediate transfer member cleaning blade 46 and the developer collecting section 47 arranged at the downstream side in the sense of the moving direction of the intermediate transfer member 40 and pooled for the next image forming operation.

Now, another embodiment of the present invention will be described below. While an AC voltage is applied to the supply roller 34Y in order to give micro-oscillations to toner particles in the above-described embodiment, an AC voltage is applied to the regulation blade 33Y instead of applying it to the supply roller 34Y.

When a bias voltage of +300 V is applied to the development roller 20Y, an AC bias voltage of equally +300 V is applied to the anilox roller 32Y and the regulation blade 33Y. At this time, an AC voltage of 0 to 600 V of a frequency of 1,500 Hz is simultaneously applied to the regulation blade 33Y that contacts the anilox roller 32Y in order to give micro-oscillations to the toner particles in the liquid developer. While the AC bias voltage may show a rectangular waveform or a sinusoidal waveform, the use of a rectangular waveform is preferable from the viewpoint of effectively achieving micro-oscillations of toner particles.

Figure 10:
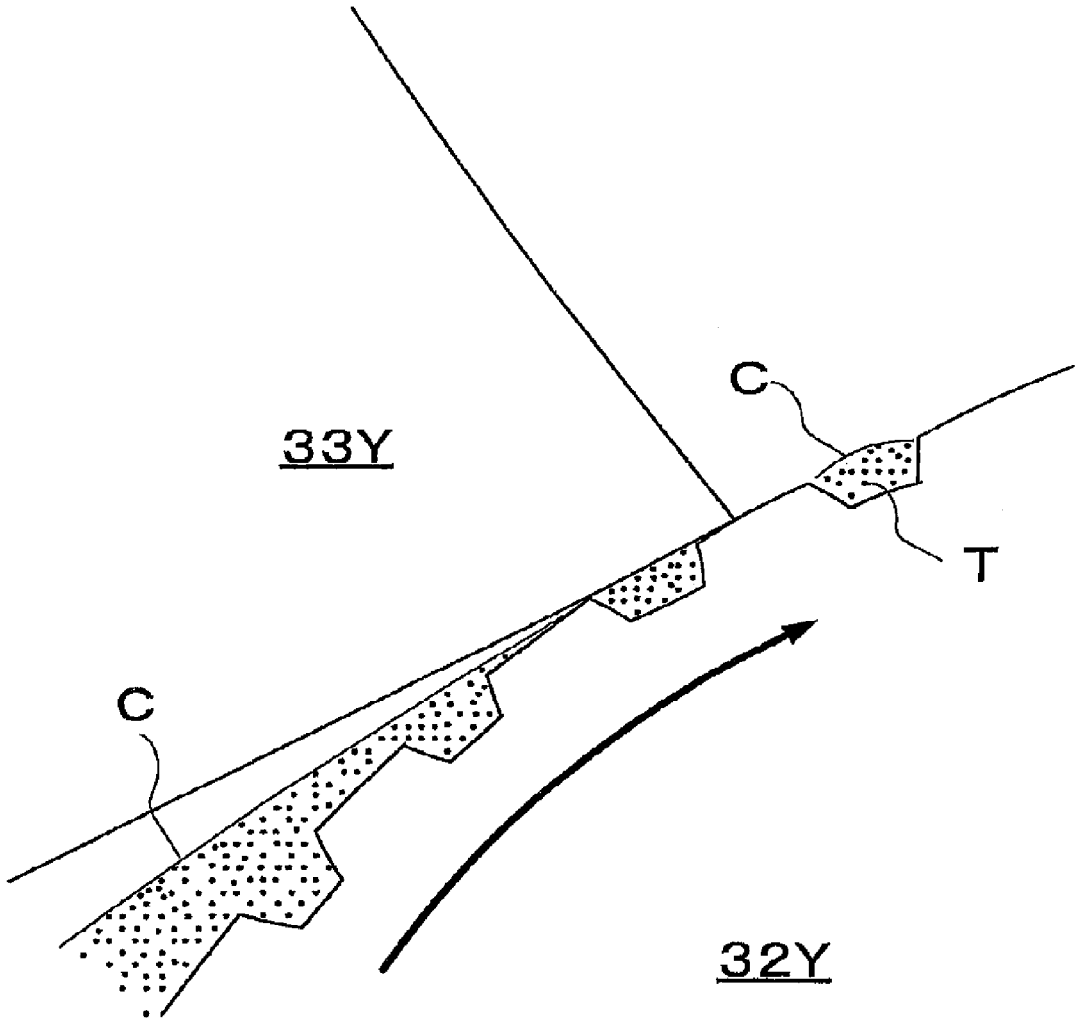
FIG. 10 is an enlarged schematic illustration of the contact area of the anilox roller 32Y and a regulation blade 33Y of the embodiment of FIG. 1.
Figure 11:
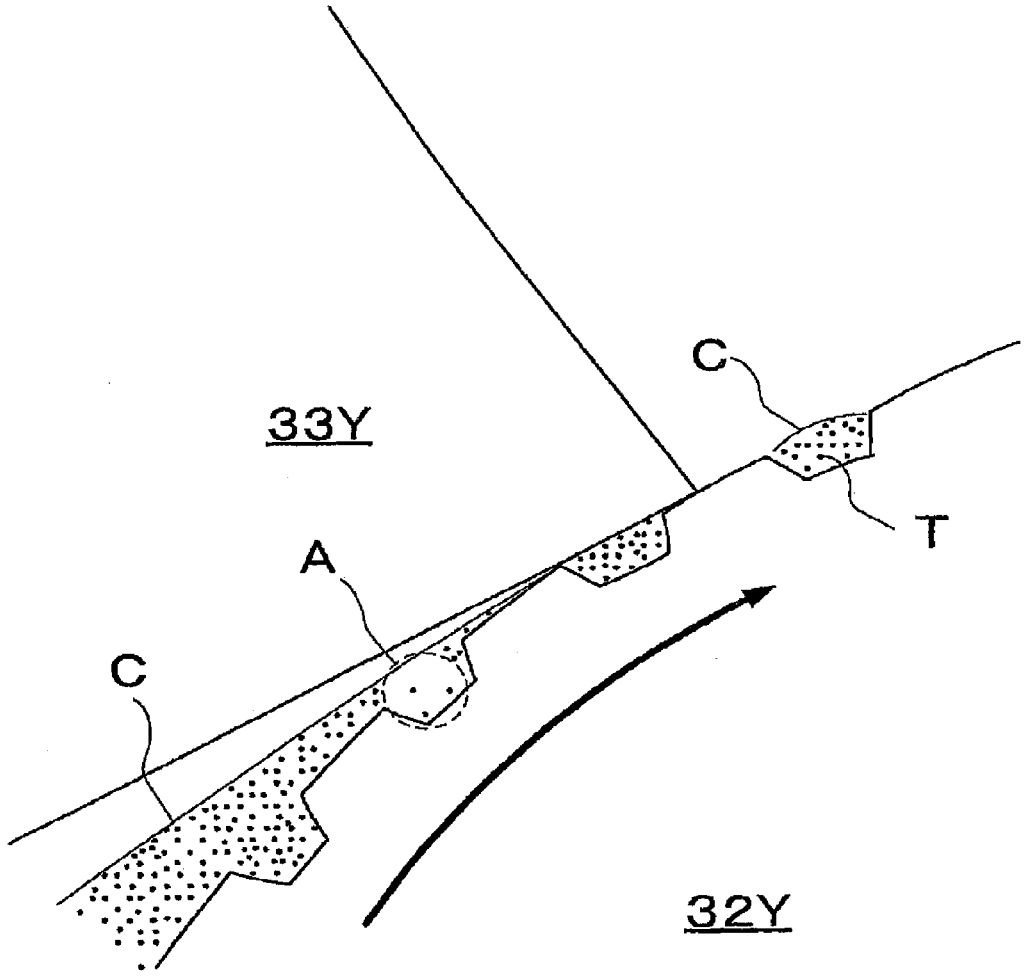
FIG. 11 is another enlarged schematic illustration of the contact area of the anilox roller 32Y and the regulation blade 33Y.

In this embodiment, an AC voltage as described above is applied to the regulation blade 33Y to give micro-oscillations to the toner particles in the liquid developer so as to uniformly disperse the toner particles in the liquid developer. FIGS. 10 and 11 are enlarged schematic illustrations of the contact area of the anilox roller 32Y and the regulation blade 33Y of this embodiment. In FIGS. 10 and 11, C denotes carrier liquid and T denotes toner particles. FIG. 10 is a schematic illustration of the contact area when an AC voltage is applied to the regulation blade 33Y, whereas FIG. 11 is a schematic illustration of the contact area when no AC voltage is applied to the regulation blade 33Y. As seen from FIG. 10, the toner particles in the liquid developer that are found between the anilox roller 32Y and the supply roller 34Y are uniformly dispersed when an AC voltage is applied to the regulation blade 33Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, toner particles are unevenly dispersed in the liquid developer and areas that are practically free from toner particles such as the one indicated by A in FIG. 11 locally appear in the liquid developer between the anilox roller 32Y and the regulation blade 33Y when no AC voltage is applied to the regulation blade 33Y. Then, as a result, minute uneven concentrations appear on the image developed on the development roller.

Figure 12:
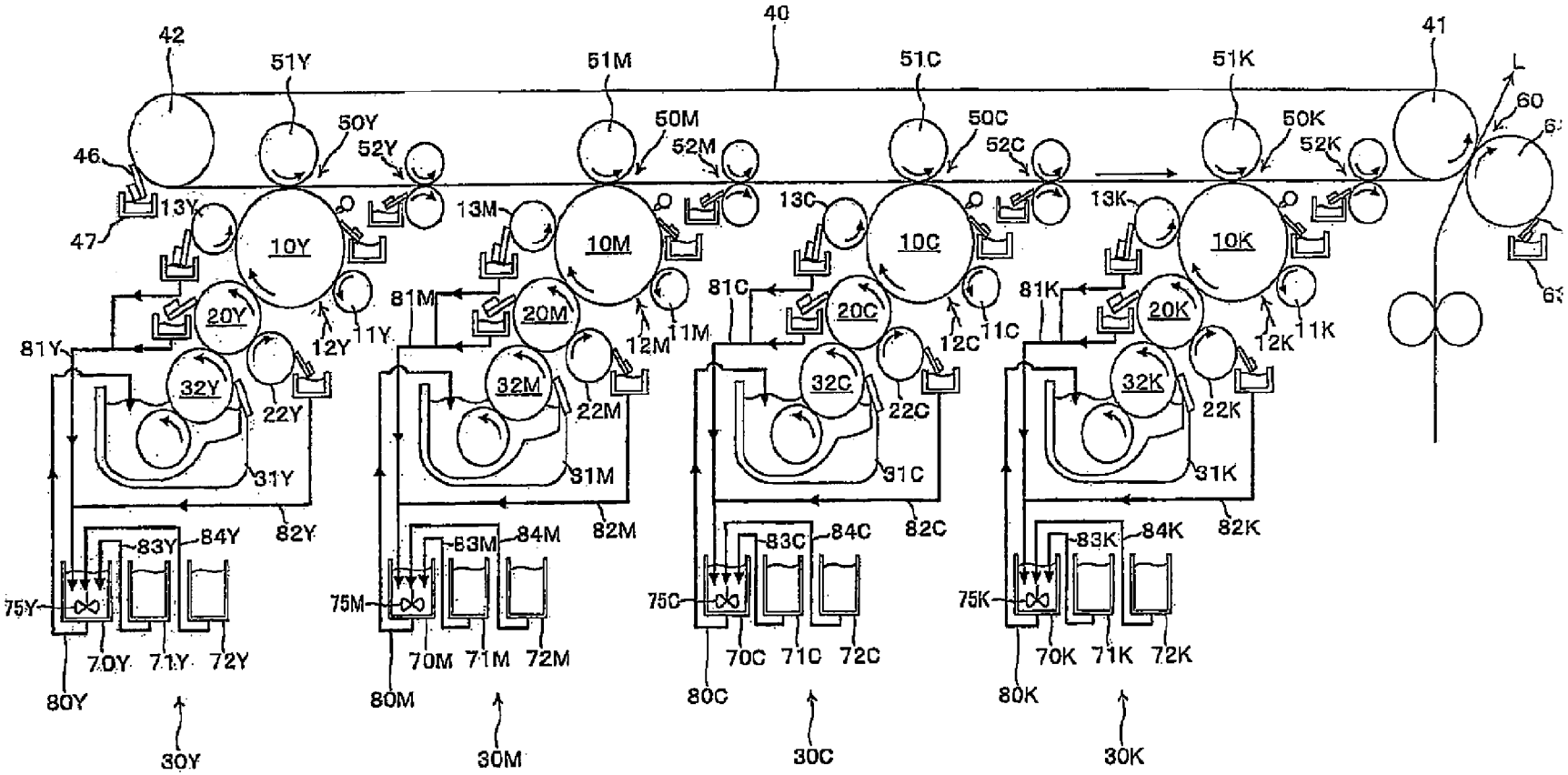
FIG. 12 is a schematic illustration of another embodiment of image forming apparatus according to the present invention, showing principal components thereof.

Now, still another embodiment of the present invention will be described by referring to the related drawings FIG. 12 is a schematic illustration of this embodiment of image forming apparatus, showing principal components thereof. While image forming sections of different colors are arranged substantially at the center of the image forming apparatus, development apparatus 30Y, 30M, 30C, 30K are arranged in a lower part of the image forming apparatus whereas an intermediate transfer member 40 and a secondary transfer section 60 are arranged in an upper part of the image forming apparatus.

The image forming sections include image bearing members 10Y, 10M, 10C, 10K, charging rollers 11Y, 11M, 11C, 11K and exposure units 12Y, 12M, 12C, 12K (not shown). The exposure units 12Y, 12M, 12C, 12K include an optical system having a semiconductor laser, a polygon mirror and an F-θ lens. Thus, the image bearing members 10Y, 10M, 10C, 10K are uniformly charged with electricity by the respective charging rollers 11Y, 11M, 11C, 11K and a laser beam is modulated according to the input video signal by the exposure units 12Y, 12M, 12C, 12K and irradiated onto the electrically charged image bearing members 10Y, 10M, 10C, 10K to form respective electrostatic images thereon.

The development apparatus 30Y, 30M, 30C, 30K respectively include development rollers 20Y, 20M, 20C, 20K, developer containers (reservoirs) 31Y, 31M, 31C, 31K containing liquid developers of yellow (Y), magenta (M), cyan (C) and black (K) and anilox rollers 32Y, 32M, 32C, 32K for supplying the liquid developers of the different colors from the developer containers 31Y, 31M, 31C, 31K to the development rollers 20Y, 20M, 20C, 20K so as to develop the electrostatic latent images formed on the image bearing members 10Y, 10N, 10C, 10K by means of the liquid developers of the different colors.

In this embodiment of developer apparatus according to the invention, image bearing member squeezing rollers 13Y, 13M, 13C, 13K are respectively held in contact with the image bearing members 10Y, 10M, 10C, 10K to provide the latter with a squeezing effect and toner compressing rollers 22Y, 22M, 22C, 22K are respectively held in contact with the development rollers 20Y, 20M, 20C, 20K to provide the latter with a compaction effect.

Agitation tanks 70Y, 70M, 70C, 70K are respectively supplied with high concentration toner from high concentration toner tanks 71Y, 71M, 71C, 71K by way of toner supply routes 83Y, 83M, 83C, 83K and at the same time with carrier oil from carrier oil tanks 72Y, 72M, 72C, 72K by way of carrier supply routes 84Y, 84M, 84C, 84K.

The liquid developers collected from the image bearing member squeezing rollers 13Y, 13M, 13C, 13K and the developer rollers 20Y, 20M, 20C, 20K by way of the respective first developer collecting routes 81Y, 81M, 81C, 81K are recycled to the respective agitation tanks 70Y, 70M, 70C, 70K. The liquid developers collected from the toner compressing rollers 22Y, 22M, 22C, 22K by way of the respective second developer collecting routes 82Y, 82M, 82C, 82K are recycled to the respective agitation tanks 70Y, 70M, 70C, 70K. If necessary, the collecting routes such as the first developer collecting routes 81Y, 81M, 81C, 81K and the supply routes such as the toner supply routes 83Y, 83M, 83C, 83K and the carrier supply routes 84Y, 84M, 84C, 84K are provided with means for forcibly moving liquid such as pumps (not shown).

The agitation tanks 70Y, 70M, 70C, 70K are respectively provided with transmission type photo-sensors (not shown) for sensing the weight ratios of the dispersed toners as concentration sensing means for controlling the concentrations of the developers in the respective tanks. The agitation tanks 70Y, 70M, 70C, 70K are also provided with respective agitation apparatus 75Y, 75M, 75C, 75K such as fins in order to agitate the high concentration toners and the carrier ails supplied to them as well as the recycled liquid developers. The photo-sensors for sensing the concentrations of the developers in the tanks may be replaced by torque sensing means for sensing the respective agitation torques of the agitation apparatus such as fins and the concentrations may be sensed by these torque sensing means.

The liquid developers agitated and regulated in the agitation tanks 70Y, 70M, 70C, 70K are supplied respectively to the developer containers (reservoirs) 31Y, 31M, 31C, 31K by way of the developer supply routes 80Y, 80M, 80C, 80X.

The concentrations of the liquid developers in the agitation tanks 70Y, 70M, 70C, 70K may be controlled by predicting the consumption of liquid developer by counting the number of dots of the image to be output at the controller (not shown) that manages video signals and then predicting the developer concentrations in the developer containers (reservoirs) 31Y, 31M, 31C, 31K on the basis of the predicted consumption of liquid developer so as to predict and control the quantities of high density toners to be supplied from the high concentration toner tanks 71Y, 71M, 71C, 71K and the quantities of carrier oil to be supplied from the carrier oil tanks 72Y, 72M, 72C, 72K. It is possible to raise the control responsiveness and the reliability of the image forming apparatus by means of such a predictive control technique.

The intermediate transfer member 40 is an endless belt that is wound between the drive roller 41 and the tension roller 42. It is driven to rotate by the drive roller 41, contacting the image bearing members 10Y, 10M, 10C, 10K at the respective primary transfer sections 50Y, 50M, 50C, 50K. The primary transfer sections 50Y, 50, 50C, 50K respectively include the image bearing members 10Y, 10N, 10C, 10K and the primary transfer rollers 51Y, 51M, 51C, 51K which are arranged opposite to the respective image bearing members 10Y, 10M, 10C, 10K with the intermediate transfer member 40 interposed between them. Thus, the developed toner images of the different colors on the image bearing members 10Y, 10M, 10C, 10K are sequentially transferred onto the intermediate transfer member 40 at the positions contacting the image bearing members 10Y, 10M, 10C, 10K so as to be laid one on the other in order to produce a full color toner image.

The secondary transfer unit 60 includes a secondary transfer roller 61 arranged opposite to the belt drive roller 41 with the intermediate transfer member 40 interposed between them as well as a cleaning apparatus that by turn includes a secondary transfer roller cleaning blade 62 and a developer collecting section 63. The monochromatic toner image or the full color toner image formed on the intermediate transfer member 40 is transferred onto a recording medium, which may be a sheet of paper, film or cloth, conveyed and brought in along the sheet member conveying route L at the transfer position where the secondary transfer roller 61 is arranged.

A fixing unit (not shown) is arranged at a downstream position of the sheet member conveying route L to fix the monochromatic toner image or the full color toner image, whichever appropriate, transferred onto the recording medium such a sheet of paper by fusion.

The tension roller 42 tensions the intermediate transfer member 40 with the belt drive roller 41. A cleaning apparatus including an intermediate transfer member cleaning blade 46 and a developer collecting section 47 is arranged at the position where the intermediate transfer member 40 is tensioned by the tension roller 42.

Figure 13:
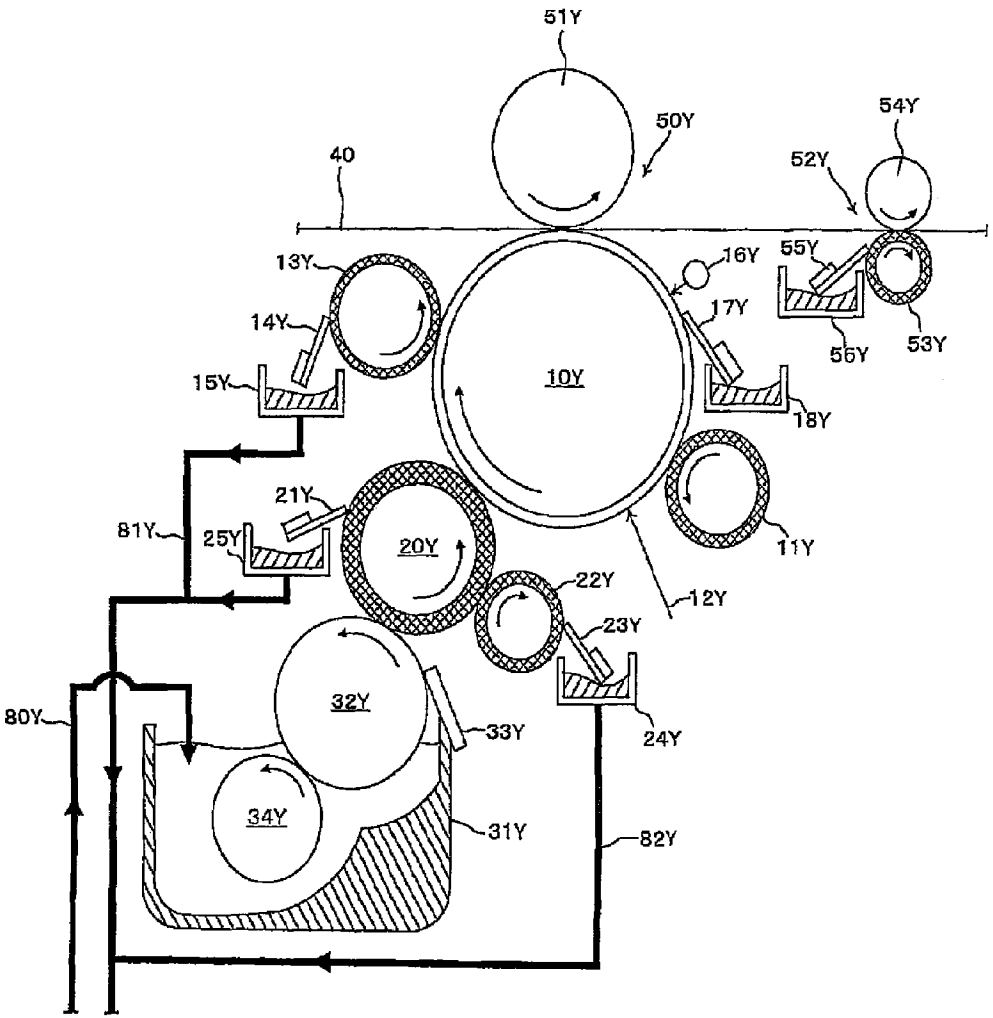
FIG. 13 is a schematic cross sectional view of principal components of one of the image forming sections and the corresponding one of the development apparatus of the embodiment of FIG. 12.

Now, the image forming sections and the development apparatus will be described. FIG. 13 is a schematic cross sectional view of principal components of one of the image forming sections and the corresponding one of the development apparatus. FIG. 3 is a schematic illustration of the compaction produced by the toner compressing roller 22Y. FIG. 4 is a schematic illustration of the development operation of the development roller 20Y. FIG. 5 is a schematic illustration of the squeezing effect of the image bearing member squeezing roller 13Y. FIG. 6 is a schematic illustration of the squeezing effect of the intermediate transfer member squeezing apparatus 52Y. Since the image forming sections and the development apparatus of the different colors have the same configuration, only the image forming section and the development apparatus of the yellow color (Y) will be described below.

In the image forming section, a cleaning apparatus including a latent image eraser 16Y, an image bearing member cleaning blade 17Y and a developer collecting section 18Y, a charging roller 11Y, an exposure unit 12Y, a development roller 20Y that belongs to the development apparatus 30Y and a cleaning apparatus including an image bearing member squeezing roller 13Y and an image bearing member squeezing roller cleaning blade 14Y and a developer collecting section 15Y that are annexes to the roller 13Y are arranged along the outer periphery of the image bearing member 10Y in the mentioned order in the sense of rotation thereof. In the development apparatus 30Y, a cleaning blade 21Y, an anilox roller 32Y and a toner compressing roller 22Y are arranged along the outer periphery of the development roller 20Y. A cleaning apparatus that includes a developer collecting section 25Y is arranged corresponding to the cleaning blade 21Y. The piping of the first developer collecting route 81Y is connected to the developer collecting section 15Y and the developer collecting section 25Y for the purpose of recycling liquid developer.

A carrier quantity regulation blade 23Y is arranged along the outer periphery of the toner compressing roller 22Y. A cleaning apparatus that includes a developer collecting section 24Y is arranged corresponding to the carrier quantity regulation blade 23Y. The piping of the second developer collecting route 82 is connected to the developer collecting section 24Y.

Additionally, the liquid developer container 31Y contains therein part of a liquid developer supply roller 34Y and the anilox roller 32Y. The primary transfer roller 51Y of the primary transfer section is arranged along the intermediate transfer member 40 at a position facing the image bearing member 10Y and an intermediate transfer member squeezing apparatus 52Y that includes an intermediate transfer member squeezing roller 53Y, a backup roller 54Y, an intermediate transfer member squeezing roller cleaning blade 55Y and a developer collecting section 56Y is arranged downstream relative to the image bearing member 10Y.

The image bearing member 10Y is a photosensitive cylindrical drum having a width greater than that of the development roller 20Y, which is about 320 mm, and carrying a photosensitive layer formed on the outer peripheral surface thereof. It is typically driven to rotate clockwise as shown in FIG. 13. The photosensitive layer of the image bearing member 10Y is an organic image bearing member or an amorphous silicon image bearing member. The charging roller 11Y is arranged at the upstream side in the sense of rotation of the image bearing member 10Y relative to the nip section formed by the image bearing member 10Y and the development roller 20Y. A bias voltage showing the polarity same as the toner charging polarity is applied to the charging roller 11Y from a power supply apparatus (not shown) to charge the image bearing member 10Y with electricity. The exposure unit 12Y is adapted to irradiate a laser beam onto the image bearing member 10Y that is electrically charged by the charging roller 11Y to form a latent image on the image bearing member 10Y at a position downstream relative to the charging roller 11Y in the sense of rotation of the image bearing member 10Y.

The development apparatus 30Y includes the toner compressing roller 22Y, the developer container 31Y for containing the liquid developer where toner is dispersed in carrier liquid by approximately 20 wt %, a development roller 20Y for bearing the liquid developer, the anilox roller 32Y, the regulation blade 33Y and the supply roller 34Y being adapted to agitate the liquid developer to maintain it in a uniformly dispersed state and supply it to the development roller 20Y, the toner compressing roller 22Y for produce a compacted state for the liquid developer borne on the development roller 20Y and a development roller cleaning blade 21Y for cleaning the development roller 20Y.

The liquid developer contained in the developer container 31Y is not the popular low concentration (about 1 to 2 wt %) and low viscosity volatile liquid developer that contains Isopar (tradename: available from Exxon) as carrier and is volatile at room temperature but a high concentration and high viscosity non-volatile liquid developer that is non-volatile at room temperature. More specifically, the liquid developer to be used for the purpose of the present invention is a high viscosity (about 30 to 10,000 mPa·s) liquid developer prepared by adding solid particles having an average particle diameter of 1 μm obtained by dispersing a coloring agent such as pigment into thermoplastic resin to a liquid solvent such as an organic solvent, silicon oil, mineral oil or edible oil along with a dispersant to make the toner solid component show a concentration of about 20%.

Figure 14:
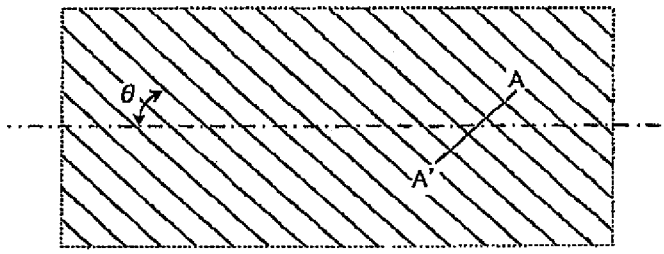
FIG. 14 is an enlarged schematic illustration of a part of the surface of an anilox roller.
Figure 15:
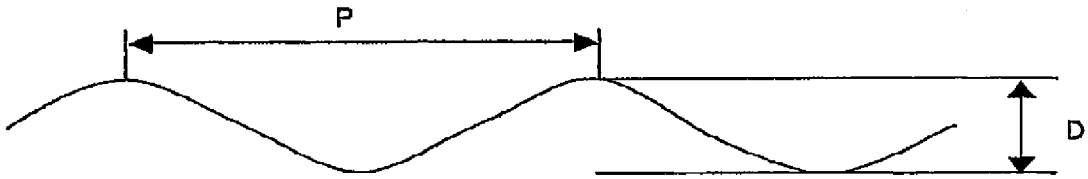
FIG. 15 is an enlarged schematic cross sectional view of the surface of the anilox roller (taken along line A-A' in FIG. 14.

Now, the anilox roller 32Y of another embodiment of the present invention will be described. FIG. 7 is a schematic illustration of the anilox roller, showing the outer profile thereof. FIG. 14 is an enlarged schematic illustration of a part of the surface of the anilox roller. FIG. 15 is an enlarged schematic cross sectional view of the surface of the anilox roller (taken along line A-A' in FIG. 14).

The anilox roller 32Y is a cylindrical member having an undulated surface produced by helical fine grooves formed regularly on the surface so that the surface may bear the developer without difficulty as shown in FIG. 7. The helical grooves can be described by means of the lead angle θ as shown in FIG. 14. The lead angle θ may well be about 45. As for the dimensions of the grooves, the pitch P of arrangement of grooves may well be 127 μm while the depth D of the grooves may well be 30 μm as shown in FIG. 15. The liquid developer is supplied from the developer container 31Y to the development roller 20Y by the anilox roller 32Y. From the viewpoint of maximizing the effect of the AC bias voltage, which will be described in greater detail hereinafter, it is desirable that the anilox roller 32Y and the supply roller 34Y are driven to rotate in the opposite senses of rotation. Then, it is possible to produce uniform film of the liquid developer from the supply roller 34Y to the anilox roller 32Y. Additionally, at least the surface of the supply roller 34Y is prepared by using an elastic member and desirably shows a surface resistance of about $10^5$ Ω·cm. The liquid developer can be supplied uniformly from the anilox roller 32Y to the development roller 20Y when they are driven to rotate in the opposite senses of rotation.

The regulation blade 33Y is an elastic blade formed by covering the surface with an elastic member. In other words, it includes a rubber section typically made of urethane rubber and adapted to contact the surface of the anilox roller 32Y and a metal plate supporting the rubber section. It is adapted to limit and regulate the film thickness and the quantity of the liquid developer borne and conveyed by the anilox roller 32Y and also regulate the quantity of the liquid developer supplied to the development roller 20Y. From the viewpoint of maximizing the effect of the AC bias voltage, which will be described in greater detail hereinafter, it is desirable that the regulation blade 33Y contacts the anilox roller 32Y by trailing contact and limits the film thickness by the surface that contacts the anilox roller 32Y. The surface resistance of the elastic blade of the regulation blade 33Y is desirably about $10^5$ O·cm.

The development roller 20Y is a cylindrical member having a width of about 320 mm and adapted to rotate counterclockwise around the rotary shaft as shown in FIG. 13. The development roller 20Y is formed by arranging an elastic layer of polyurethane rubber, silicon rubber or NBR around the outer periphery of a metal inner core made of a metal such as iron. The development roller cleaning blade 21Y is typically made of rubber. It is adapted to contact the surface of the development roller 20Y and arranged at the downstream side relative to the development nip section where the development roller 20Y contacts the image bearing member 10Y in the sense of rotation of the development roller 20Y so as to remove the liquid developer remaining on the development roller 20Y by scraping off. The liquid developer that is scraped off there is recycled from the developer collecting section 25Y by way of the piping of the first developer collecting route 81Y.

The toner compressing roller 22Y is a cylindrical member. As shown in FIG. 3 and similar to the development roller 20Y, the roller 22Y is formed by arranging an elastic member 22-1Y as cover layer. It shows a structure having a metal roller base member and a resin layer or a rubber layer arranged on the surface of the base member. For instance, as shown in FIG. 13, it is driven to rotate clockwise in the sense opposite to the sense of rotation of the development roller 20Y. The toner compressing roller 22Y has a means for raising the charging bias voltage of the surface of the development roller 20Y. Thus, the developer brought in by the development roller 20Y applies an electric field toward the development roller 20Y from the side of the toner compressing roller 22Y at the toner compressing position where the toner compressing roller 22Y contacts to form a nip section and slides as shown in FIGS. 13 and 3. The roller that operates as toner compressing and electric field applying means shown in FIG. 13 may be replaced by a corona discharger for corona discharges.

As shown in FIG. 3, the toner compressing roller 22Y moves the toner T that is uniformly dispersed in the carrier C to the side of the development roller 20Y to produce a so-called compacted toner condition T'. As the toner compressing roller 22Y rotates in the sense of the arrow in FIG. 3, part of the carrier C and some toner T" that is not compacted, the carrier C and the toner T" are scraped off and removed by the carrier quantity regulation blade 23Y so that they are merged with the developer in the reservoir 31Y for recycling. The carrier quantity regulation blade 23Y will be described later. On the other hand, the developer D borne by the developer roller 20Y and held in the compacted toner condition develops the latent image on the image bearing member 10Y at the development nip section where the development roller 20Y contacts the image bearing member 10Y as shown in FIG. 4 as a desired electric field is applied to it. The developer D that is not consumed for the development is scraped off by the developer roller cleaning blade 21Y and recycled from the developer collecting section 24Y by way of the piping of the second developer collecting route 82Y. The carrier and the toner that are merged are not in the color mixing condition.

The image bearing member squeezing apparatus is arranged opposite to the image bearing member 10Y and below the developer 20Y to collect the excessive developer from the developed toner image on the image bearing member 10Y. As shown in FIGS. 13 and 5, it includes an image bearing member squeezing roller 13Y that is an elastic roller member having a surface elastic member 13-1Y and held in sliding contact with the image bearing member 10Y and a cleaning blade 14Y slidably pressed against the image bearing member squeezing roller 13Y to clean the surface of the latter. As shown in FIG. 5, it operates to collect the excessive carrier C and the unnecessary fogging toner T" from the developer D used for developing the latent image on the image bearing member 10Y in order to raise the toner particle ratio in the developed visible image. The collecting capacity to collect the excessive carrier C of the image bearing member squeezing apparatus can be selected by defining the sense of rotation of the image bearing member squeezing roller 13Y and the difference between the peripheral speed of the surface of the image bearing member 10Y and that of the surface of the image bearing member squeezing roller 13Y. The capacity is raised when the image bearing member squeezing roller 13Y is driven to rotate in the sense opposite to the sense of rotation of the image bearing member 10Y and also when the difference of peripheral speed is increased. A synergetic effect can be obtained by appropriately selecting the sense of rotation and the peripheral speed difference.

In this embodiment, the image bearing member squeezing roller 13Y is driven to rotate with the image bearing member 10Y in the same sense of rotation substantially at the same peripheral speed as shown in FIG. 5 in order to collect the excessive carrier C that is about 5 to 10 wt % of the developer D consumed for developing the latent image on the image bearing member 10Y. With this arrangements it is possible to reduce the load of driving the two rollers and minimize the effects of external turbulences on the developed visible toner image on the image bearing member 10Y. The excessive carrier C and the unnecessary fogging toner T" collected by the image bearing member squeezing roller 13Y is collected in the developer collecting section 15Y from the image bearing member squeezing roller 13Y and recycled by way of the piping of the first developer collecting route 81Y. Note that, since the excessive carrier C and the fogging toner T" are collected from the dedicated and isolated image bearing member 10Y, no color mixing phenomenon appears throughout the image forming apparatus.

The primary transfer section 50Y transfers the developer image developed on the image bearing member 10Y onto the intermediate transfer member 40 by means of the primary transfer roller 51Y. The image bearing member 10Y and the intermediate transfer member 40 are configured to be driven to move at the same speed to reduce the load of driving the primary transfer roller 51Y to rotate and the intermediate transfer member 40 to move and this configuration minimizes the effect of external turbulences to the visible toner image on the image bearing member 10Y. While no color mixing phenomenon appears at the primary transfer section 50Y that is the transfer section for the first color, other toner images are laid on the toner image from the primary transfer section 50Y in the second and subsequent primary transfer sections. Then, a so-called inverse transfer phenomenon appears and toner is moved from the intermediate transfer member 40 to the image bearing members 10 (M, C, K). Thus, the inversely transferred toner and the residual toner left after the image transfer operations are mixed and borne by the image bearing members 10 (M, C, K) to move until they are collected from the image bearing members by the cleaning blades 17 (M, C, K) and pooled.

The intermediate transfer member squeezing apparatus 52Y is arranged at the downstream side of the primary transfer section SOY to remove the excessive carrier liquid from the surface of the intermediate transfer member 40 to raise the toner particle ratio in the developed visible image. It is provided as a means for removing any excessive carrier liquid from the intermediate transfer member 40 when the quantity of carrier liquid in the developer (the toner dispersed in the carrier) transferred onto the intermediate transfer member 40 at the primary transfer section 50Y is short of about 40 wt % to 60 wt % in a dispersed condition of the liquid developer that is required to realize a desired secondary transfer function and the fixing function when the image is transferred onto a sheet by secondary transfer and proceeded to the fixing process to ultimately complete the operation. Like the image bearing member squeezing apparatus, the intermediate transfer member squeezing apparatus 52Y includes an intermediate transfer member squeezing roller 53Y having a surface elastic member and held in sliding contact with the image bearing member 40, a backup roller 54Y arranged opposite to the intermediate transfer member squeezing roller 53Y with the image bearing member 40 interposed between them, a cleaning blade 55Y slidably pressed against the intermediate transfer member squeezing roller 53Y to clean the surface of the latter and a developer collecting section 56Y so as to operate to collect the excessive carrier C and the unnecessary fogging toner T" from the developer D transferred on the intermediate transfer member 40 in the primary transfer operation as shown in FIG. 6. The developer collecting section 56Y also operates as a carrier liquid collecting mechanism for collecting the carrier liquid collected by the magenta image bearing member squeezing roller cleaning blade 14 arranged at the downstream side thereof.

The capacity for collecting excessive carrier liquid can be selected by appropriately defining the sense of rotation of the intermediate transfer member squeezing roller 53Y and the difference between the moving speed of the intermediate transfer member 40 and the speed of the surface of the intermediate transfer member squeezing roller 53Y. The capacity is raised when the intermediate transfer member squeezing roller 53Y is driven to rotate in the sense opposite to the moving direction of the intermediate transfer member 40 and also when the difference of peripheral speed is increased. A synergetic effect can be obtained by appropriately selecting the sense of rotation and the peripheral speed difference. In this embodiment, the intermediate transfer member squeezing roller 53Y is driven to rotate with the intermediate transfer member 40 in the same sense of rotation substantially at the same peripheral speed in order to collect the excessive carrier liquid and the fogging toner that are about 5 to 10 wt % of the developer D transferred onto the intermediate transfer member 40 in the primary transfer. With this arrangement, it is possible to reduce the load of driving the two members and minimize the effects of external turbulences of the intermediate transfer member 40 to the developed toner image.

While no color mixing phenomenon appears at the intermediate transfer member squeezing position of the first color because the first intermediate transfer member squeezing operation takes place there, other toner images of the second and subsequent colors are laid on the toner image of the first color produced as a result of primary transfer so that the toner moved from the intermediate transfer member 40 to the intermediate transfer member squeezing roller 53Y is mixed in terms of color and borne by the intermediate transfer member squeezing roller 53Y with the excessive carrier liquid so as to be moved, collected and pooled by the operation of the cleaning blades. If both the squeezing capacity of the image bearing members 40 at the upstream side primary transfer positions of the above-described intermediate transfer member squeezing process and the squeezing capacity of the image bearing member squeezing roller 53Y are sufficient, it is not necessary to arrange an intermediate transfer member squeezing apparatus at the downstream side of each of the primary transfer processes.

Now, the operation of the image forming apparatus according to the embodiment of the present invention will be described below. Only the image forming section of the yellow color (Y) of the development apparatus 30Y of this embodiment will be described below out of the four image forming sections of the development apparatus for the above-described reason.

Figure 20:
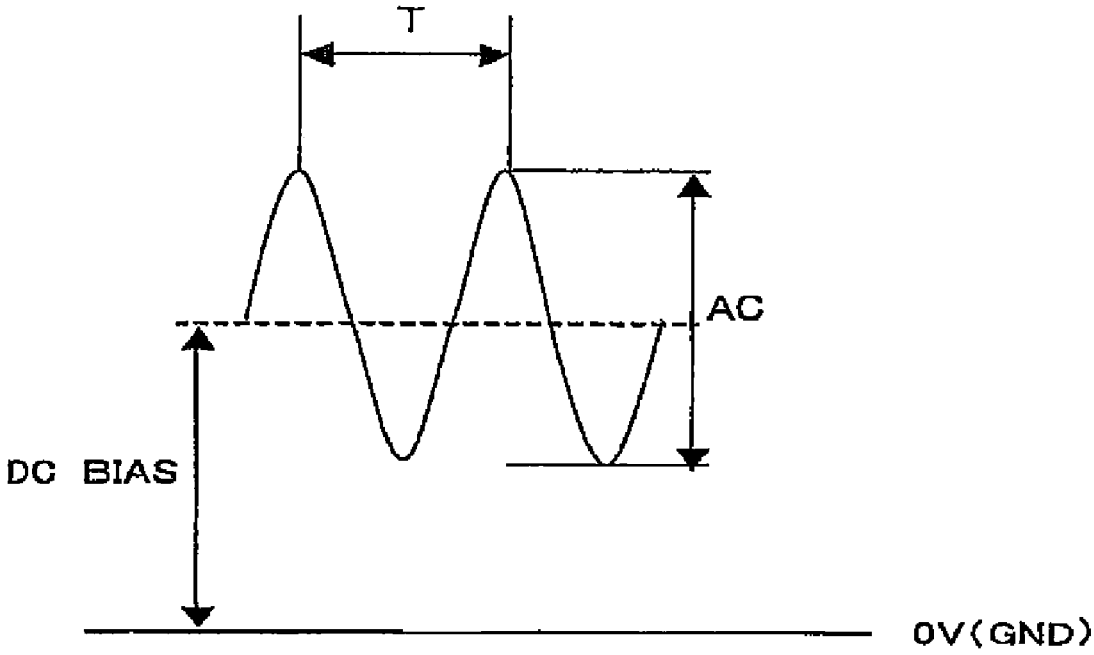
FIG. 20 is a graph illustrating the waveform of the AC bias voltage applied to the grooves of the anilox roller of the embodiment of FIG. 12.

The toner particles in the liquid developer in the developer container 31Y have a positive electric charge and the liquid developer is agitated by the supply roller 34Y and sucked up from the developer container 31Y as the anilox roller 32Y is driven to rotate. At this time, if a bias voltage of +300 V, for instance, is applied to the development roller 20Y, the same DC bias voltage of +300 V is also applied to the anilox roller 32Y. The toner particles in the liquid developer are subjected to micro-oscillations by applying both a DC bias voltage of +300 V and an AC voltage of 0 to 600 V of a frequency of 1,500 Hz simultaneously to the supply roller 34Y. FIG. 20 is a graph illustrating the waveform of the AC bias voltage applied to the grooves of the anilox roller of this embodiment. While the AC bias voltage may well show a rectangular waveform or a sinusoidal waveform, the use of a rectangular waveform is preferable from the viewpoint of effectively achieving micro-oscillations of toner particles.

Figure 16:
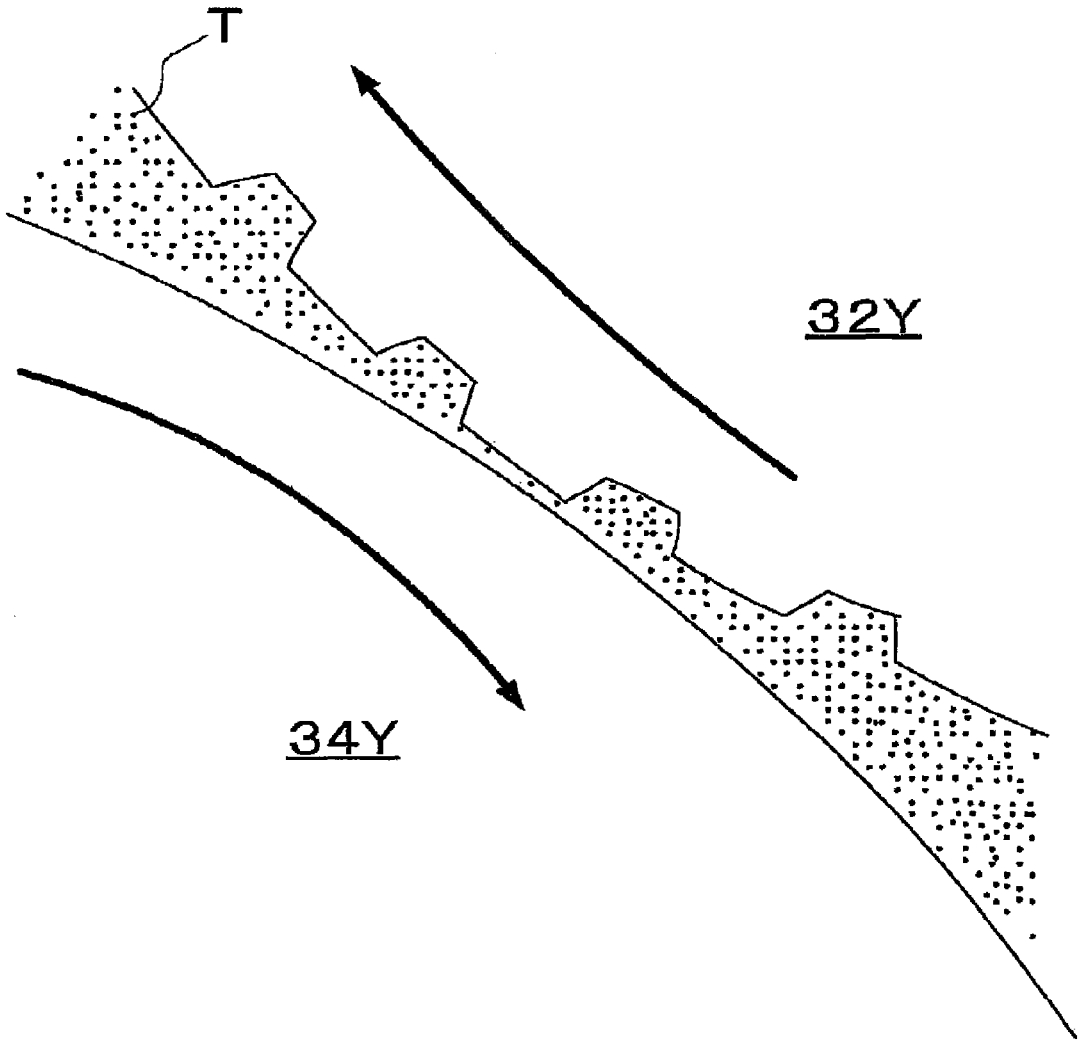
FIG. 16 is an enlarged schematic illustration of the contact area of an anilox roller 32Y and a supply roller 34Y of the embodiment of FIG. 12.
Figure 17:
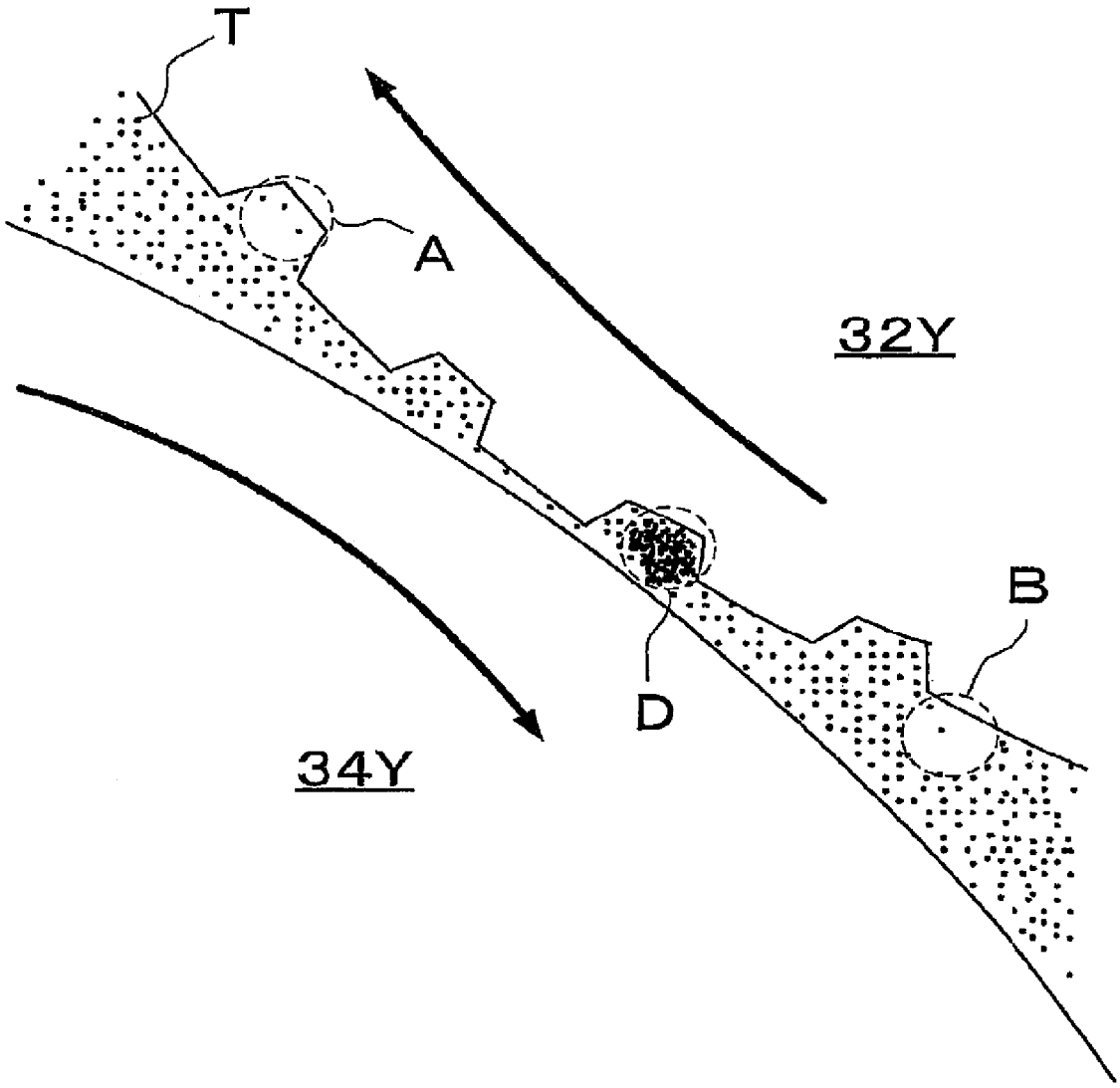
FIG. 17 is another enlarged schematic illustration of the contact area of the anilox roller 32Y and the supply roller 34Y of the embodiment of FIG. 12.

The toner particles in the liquid developer are uniformly dispersed as an AC voltage is applied to the supply roller 34Y to subject the toner particles to micro-oscillations. FIGS. 16 and 17 are enlarged schematic illustrations of the contact area of the anilox roller 32Y and the supply roller 34Y. In FIGS. 16 and 17, T denotes toner particles. FIG. 16 is a schematic illustration of the contact area when an AC voltage is applied to the supply roller 34Y, whereas FIG. 17 is a schematic illustration of the contact area when no AC voltage is applied to the supply roller 34Y. As seen from FIG. 16, the toner particles in the liquid developer that are found between the anilox roller 32Y and the supply roller 34Y are uniformly dispersed when an AC voltage is applied to the supply roller 34Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, toner particles are unevenly dispersed in the liquid developer and areas that are practically free from toner particles such as those indicated by A and B in FIG. 17 appear in the liquid developer between the anilox roller 32Y and the supply roller 34Y when no AC voltage is applied to the supply roller 34Y. Then, as a result, minute uneven concentrations appear on the image developed on the development roller.

A recycling system is established in the development apparatus 30Y of this embodiment in such a way that the liquid developer compacted by the toner compressing roller 22Y and the liquid developer scraped off by the image bearing member squeezing roller 13Y are recycled from the liquid developer collecting sections 15Y, 24Y, 25Y. Therefore, the toner in the liquid developer fed back to the agitation tank 70Y includes aggregates. The agitation tank 70Y is equipped with an agitation apparatus 75Y and the toner aggregates are partly but not satisfactorily dissolved by the agitation apparatus 75Y. More specifically, when an AC voltage is not applied to the supply roller 34Y, toner aggregates locally exist in the liquid developer found between the anilox roller 32Y and the supply roller 34Y as indicated by D in FIG. 17 so that a minute uneven concentration can appear on the image developed on the development roller.

In view of this problem, an AC bias voltage is applied to the liquid developer in the grooves of the anilox roller to dissolve the toner aggregates and uniformly disperse toner particles in the carrier oil. With this arrangement, no minute uneven concentration appears on the image ultimately developed on the development roller. Then, no uneven image quality occurs to the image ultimately transferred onto a recording medium.

In the image forming apparatus of this embodiment that utilizes a developer where toner is dispersed in carrier liquid, the developer is prepared by dispersing toner into the carrier liquid by about 20 wt % relative to about 80 wt % of the carrier liquid. After the various image forming processes, about 45% in the case of coat paper or some other glossy paper, about 55% in the case of ordinary paper and about 60% in the case of rough paper such as recycled paper where fibers are arranged coarsely are selected as respective target values for the toner weight ratio (solid content ratio) at the so-called secondary transfer position immediately before the operation of transferring the image on a sheet of paper or the like takes place as secondary transfer. In the initial stages, toner is dispersed in the carrier liquid to show a toner weight ratio of about 20% in the developer contained in the developer container 31Y. However, toner consumption rate is high when the so-called image duty is high in the process of developing the latent image on the image bearing member 10Y, whereas the toner consumption rate is low when the so-called image duty is low. In other words, the toner weight ratio of the developer contained in the developer container 31Y changes incessantly as the latent image on the image bearing member 10Y is developed so that it is necessary to constantly monitor the change and maintain the dispersed condition of toner to hold the toner weight ratio to about 20 wt %.

The regulation blade 33Y is held in contact with the surface of the anilox roller 32Y to scrape off the excessive liquid developer, while leaving the liquid developer in the grooves of the undulations of the anilox pattern formed on the surface of the anilox roller 32Y, in order to regulate the quantity of liquid developer supplied to the development roller 20Y. With this arrangement for regulation, the film thickness of the film layer of the liquid developer applied to the development roller 20Y is constantly held to about 6 μm. The liquid developer scraped off by the regulation blade 33Y is made to fall into the developer container 31Y by its own gravity, while the liquid developer not scraped off by the regulation blade 33Y is contained in the grooves of the undulations on the surface of the anilox roller 32Y and then applied to the surface of the development roller 20Y as the anilox roller 32Y is held in contact with and pressed against the development roller 20Y.

The surface of the development roller 20Y to which the liquid developer is applied by the anilox roller 32Y then contacts the toner compressing roller 22Y at a position downstream relative to the nip section formed by itself and the surface of the anilox roller 32Y. A bias voltage of about +300 V is applied to the development roller 20Y and a bias voltage higher than the bias voltage being applied to the development roller 20Y and showing a polarity same as the polarity of the electric charge of the toner is applied to the toner compressing roller 22Y. For example, a bias voltage of about +600 V may be applied to the toner compressing roller 22Y. Then, the toner particles in the liquid developer on the development roller 20Y are moved to the side of the development roller 20Y when they pass the nip section formed by the development roller 20Y and the toner compressing roller 22Y as shown in FIG. 3. As a result, the developer moved to the development roller 20Y shows a filmy state where toner particles are loosely bonded so that toner particles can move quickly from the development roller 20Y to the image bearing member 10Y to consequently raise the image density of the image developed on the image bearing member 10Y.

The image bearing member 10Y is made of amorphous silicon. The surface of the image bearing member 10Y is charged with electricity by the charging roller 11Y to about +600 V at a position upstream relative to the nip section and the development roller 20Y and subsequently a latent image is formed by the exposure unit 12Y in such a way that the image area shows an electric potential of +25 V. At the development nip section formed by the development roller 20Y and the image bearing member 10Y, toner particles T are selectively moved onto the image bearing member 10Y as shown in FIG. 4 according to the electric field produced by the bias voltage of +300 V being applied to the development roller 20Y and the latent image on the image bearing member 10Y (image area: +25 V, non-image area: +600 V) so that a toner image is formed on the image bearing member 10Y. Since the carrier liquid C is not influenced by the electric field, it is separated into two parts at the exit of the development nip section formed by the development roller 20Y and the image bearing member 10Y so as to adhere to both the development roller 20Y and the image bearing member 10Y The image bearing member 10Y that passes the development nip section then passes the image bearing member squeezing roller 13Y, where the excessive carrier liquid C is removed as shown in FIG. 5 to raise the toner particle content ratio in the visible image.

Then, the image bearing member 10Y passes the nip section formed by the intermediate transfer member 40 and itself at the primary transfer section 50Y, where the visible toner image is transferred onto the intermediate transfer member 40 in a primary transfer operation. As voltage of about −200 V is applied to the primary transfer roller 51Y with the polarity opposite to that of the electric charge of toner particles, the toner is transferred from the image bearing member 10Y onto the intermediate transfer member 40 as a result of a primary transfer operation to leave only the carrier liquid on the image bearing member 10Y. The electrostatic latent image on the image bearing member 10Y is removed by the latent image eraser 16Y, that is typically formed by using an electric lamp, at the downstream side of the image bearing member 10Y relative to the primary transfer section in the sense of rotation thereof and the carrier liquid left on the image bearing member 10Y is scraped off by the image bearing member cleaning blade 17Y and collected by the developer collecting section 18Y.

The toner image transferred onto the intermediate transfer member 40 at the primary transfer section 50Y as a result of a primary transfer operation passes the intermediate transfer member squeezing apparatus 52Y, which scrapes off the excessive carrier liquid on the intermediate transfer member 40. A voltage of +400 V is applied to the intermediate transfer member squeezing roller 53Y of the intermediate transfer member squeezing apparatus 52Y and a voltage of +200 V is applied to the intermediate transfer member squeezing backup roller 54Y to generate an electric field that presses toner particles against the intermediate transfer member 40. Therefore, as a result, no toner particles are collected by the intermediate transfer member squeezing roller 53Y as shown in FIG. 6 and only the carrier liquid that is not affected by the electric field is isolated between the intermediate transfer member 40 and the intermediate transfer member squeezing roller 53Y and collected.

The toner image on the intermediate transfer member 40 then proceeds to the secondary transfer unit 60 and moves into the nip section formed by the intermediate transfer member 40 and the secondary transfer roller 61. The nip section is made to show a width of 3 mm. In the secondary transfer unit 60, voltages of −1,200 V and +200 V are applied respectively to the secondary transfer roller 61 and the belt drive roller 41 to transfer the toner image on the intermediate transfer member 40 onto a recording medium, which may typically be a sheet of paper.

After passing the secondary transfer unit 60, the intermediate transfer member 40 proceeds to a winding part of the tension roller 42, where the surface of the intermediate transfer member 40 is cleaned by the intermediate transfer member cleaning blade 46, and then further to the primary transfer section 50 once again.

Now, the squeezing feature of the secondary transfer roller 61 will be described below. The sheet member is supplied to the secondary transfer position at the timing when the toner image formed by laying toner images of different colors arrives at the secondary transfer position and the toner image is transferred onto the sheet member in a secondary transfer process. Then, the sheet member is made to proceed to the fixing process (not shown) to ultimately complete the operation of forming an image on the sheet member. When trouble such as a jammed sheet member takes place, the toner image is transferred onto the secondary transfer roller 61 without the sheet member laid on the secondary transfer roller 61 to consequently smear the rear surface of the following sheet member. In this embodiment, the secondary transfer roller 61 is formed by using an elastic roller equipped with an elastic member arranged on the surface thereof so as to follow the surface profile of a sheet member if the surface of the sheet member is fibrous and not smooth and improve the secondary transfer performance just like the elastic belt of the intermediate transfer member 40 for carrying the toner images formed on a plurality of photosensitive members and sequentially transferred onto and laid on it one on the other before the toner images are collectively transferred onto a sheet member in a secondary transfer operation. The secondary transfer roller cleaning blade 62 is provided as a means for removing the developer (containing toner dispersed in carrier liquid) transferred onto the secondary transfer roller 61 and the developer collected from the secondary transfer roller 61 is pooled. Note that the pooled developer shows a color mixing phenomenon and can contain foreign objects such as paper dust.

Now, the cleaning apparatus of the intermediate transfer member 40 will be described below. When trouble such as a jammed sheet member takes place, not all the toner image is transferred onto the secondary transfer roller 61 and collected but partly left on the intermediate transfer member 40. In the ordinary secondary transfer process, the toner image on the intermediate transfer member 40 is not transferred onto a sheet member by 100%. In other words, the toner image is partly left on the intermediate transfer member 40 by several percents after the secondary transfer process. The toner of either of the above-listed two unnecessary toner images is collected by the intermediate transfer member cleaning blade 46 and the developer collecting section 47 arranged at the downstream side in the sense of the moving direction of the intermediate transfer member 40 and pooled for the next image forming operation.

Now, still another embodiment of the present invention will be described. While an AC voltage is applied to the supply roller 34Y in order to give micro-oscillations to toner particles in the above-described embodiment, an AC voltage is applied to the regulation blade 33Y instead of applying it to the supply roller 34Y.

When a bias voltage of +300 V is applied to the development roller 20Y, a DC bias voltage of equally +300 V is applied to the anilox roller 32Y and the regulation blade 33Y. At this time, an AC voltage of 0 to 600 V of a frequency of 1,500 Hz is simultaneously applied to the regulation blade 33Y that contacts the anilox roller 32Y in order to give micro-oscillations to the toner particles in the liquid developer. While the AC bias voltage may show a rectangular waveform or a sinusoidal waveform, the use of a rectangular waveform is preferable from the viewpoint of effectively achieving micro-oscillations of toner particles.

Figure 18:
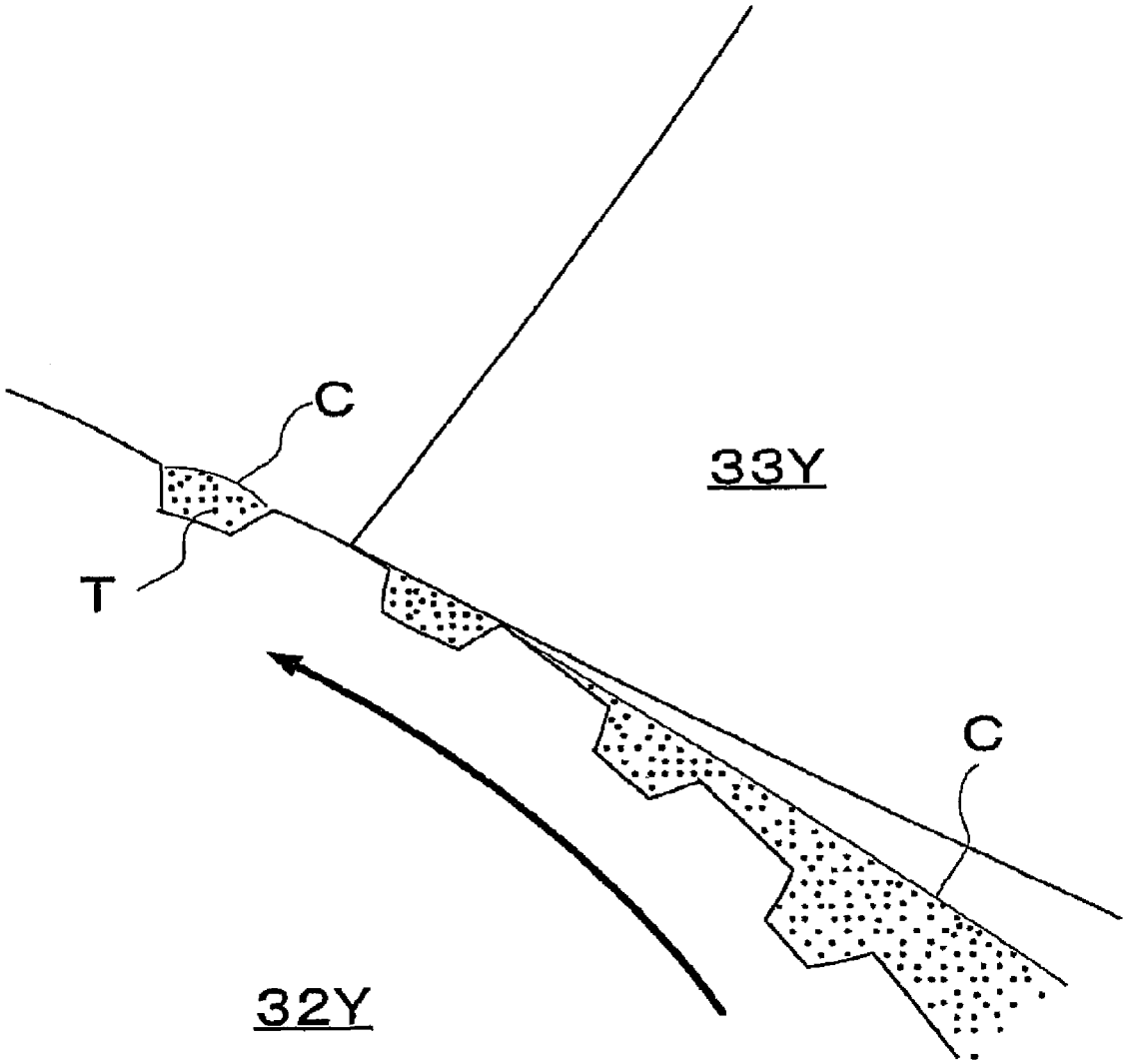
FIG. 18 is an enlarged schematic illustration of the contact area of the anilox roller 32Y and a regulation blade 33Y of the embodiment of FIG. 12.
Figure 19:
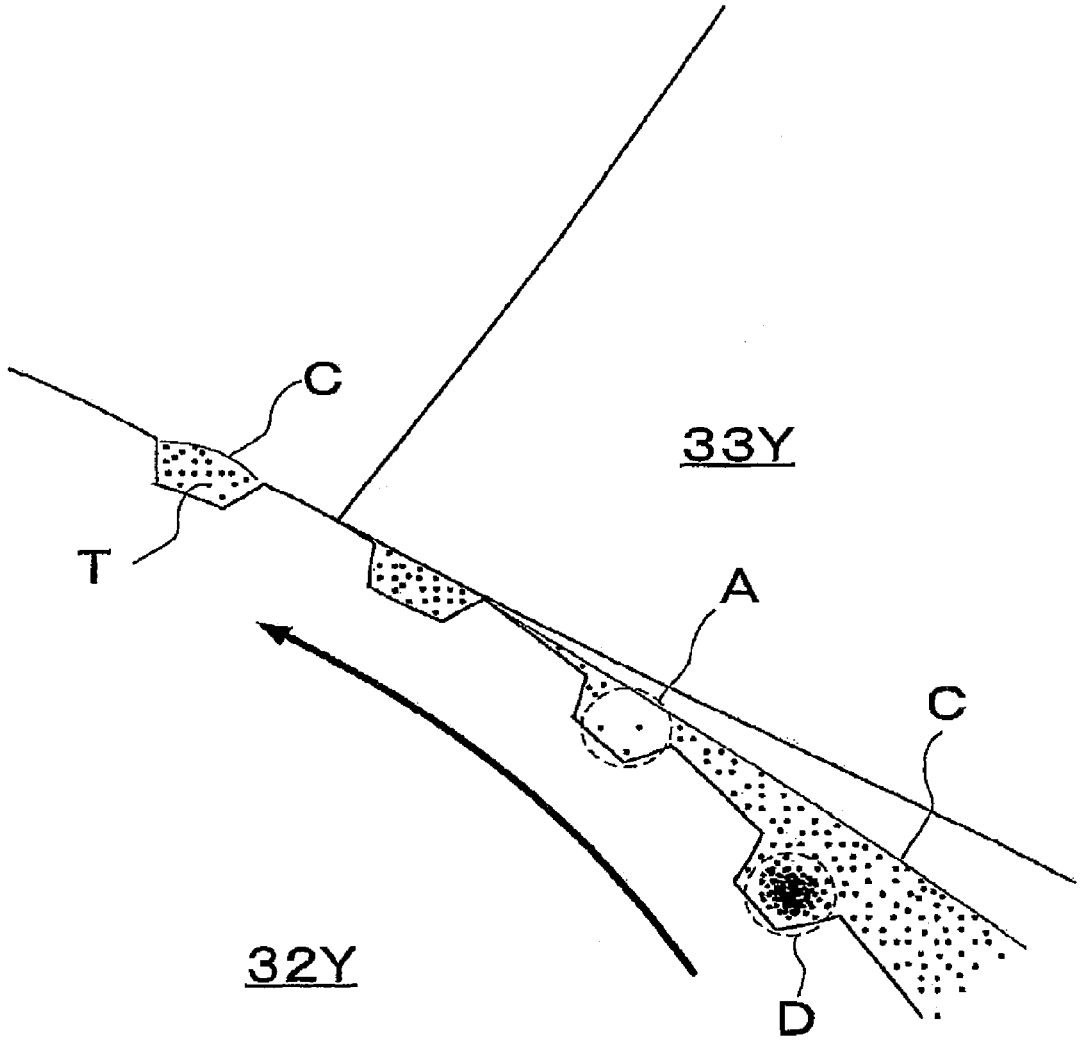
FIG. 19 is another enlarged schematic illustration of the contact area of the anilox roller 32Y and the regulation blade 33Y of the embodiment of FIG. 12.

In this embodiment, an AC voltage as described above is applied to the regulation blade 33Y to give micro-oscillations to the toner particles in the liquid developer so as to uniformly disperse the toner particles in the liquid developer. FIGS. 18 and 19 are enlarged schematic illustrations of the contact area of the anilox roller 32Y and the regulation blade 33Y. In FIGS. 18 and 19, C denotes carrier liquid and T denotes toner particles. FIG. 18 is a schematic illustration of the contact area when an AC voltage is applied to the regulation blade 33Y, whereas FIG. 19 is a schematic illustration of the contact area when no AC voltage is applied to the regulation blade 33Y. As seen from FIG. 18, the toner particles in the liquid developer that are found between the anilox roller 32Y and the supply roller 34Y are uniformly dispersed when an AC voltage is applied to the regulation blade 33Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, toner particles are unevenly dispersed in the liquid developer and areas that are practically free from toner particles such as the one indicated by A in FIG. 19 locally appear in the liquid developer between the anilox roller 32Y and the regulation blade 33Y when no AC voltage is applied to the regulation blade 33Y. Then, as a result, minute uneven concentrations appear on the image developed on the development roller.

A recycling system is established in the development apparatus 30Y of this embodiment in such a way that the liquid developer compacted by the toner compressing roller 22Y and the liquid developer scraped off by the image bearing member squeezing roller 13Y are recycled from the liquid developer collecting sections 15Y, 24Y, 25Y. Therefore, the toner in the liquid developer fed back to the agitation tank 70Y includes aggregates. The agitation tank 70Y is equipped with an agitation apparatus 75Y and the toner aggregates are partly but not satisfactorily dissolved by the agitation apparatus 75Y. More specifically, when an AC voltage is not applied to the regulation blade 33Y, toner aggregates locally exist in the liquid developer found between the anilox roller 32Y and the regulation blade 33Y as indicated by D in FIG. 19 so that a minute uneven concentration can appear on the image developed on the development roller.

In view of this problem, an AC bias voltage is applied to the liquid developer in the grooves of the anilox roller to dissolve the toner aggregates and uniformly disperse toner particles in the carrier oil. With this arrangement, no minute uneven concentration appears on the image ultimately developed on the development roller. Then, no uneven image quality occurs to the image ultimately transferred onto a recording medium.

Figure 21:
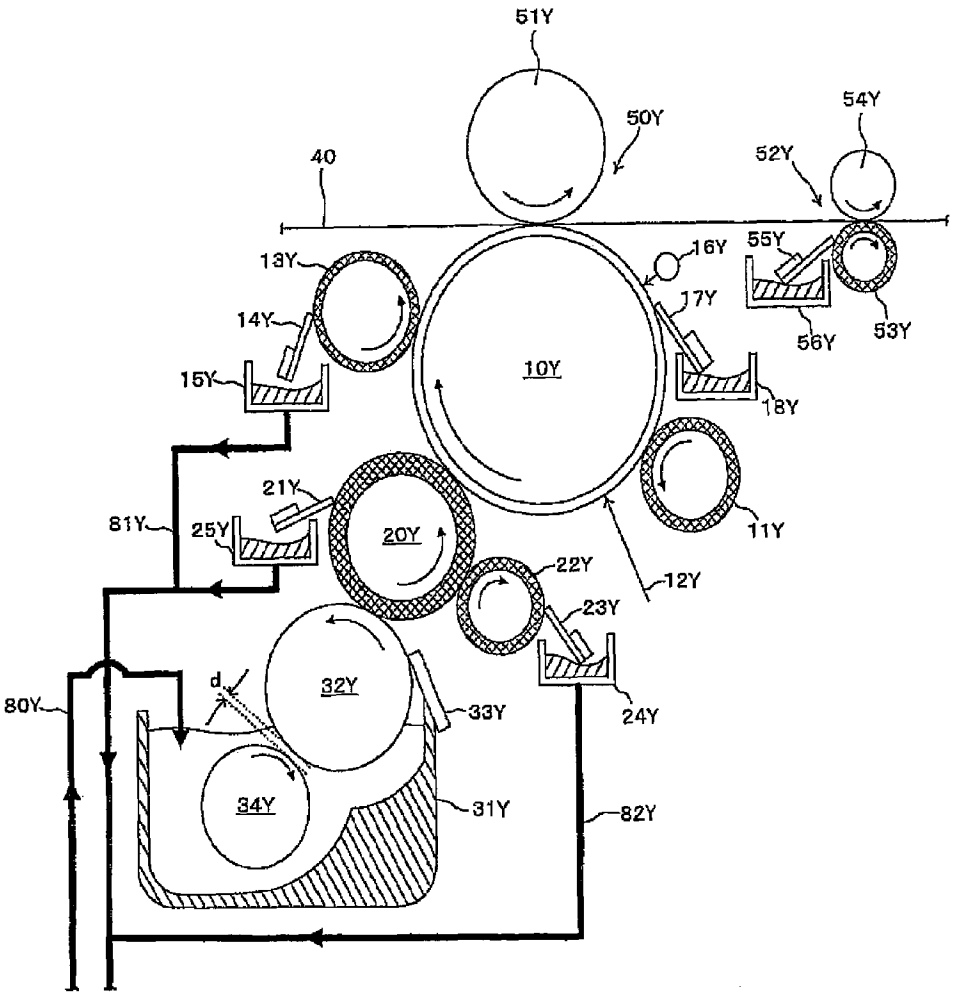
FIG. 21 is a schematic cross sectional view of principal components of one of the development units of an embodiment of development apparatus according to the present invention.

Now, still another embodiment of development apparatus according to the present invention will be described below. FIG. 21 is a schematic cross sectional view of principal components of one of the development units of the development apparatus according to the embodiment of the present invention. The components same as or similar to those of the preceding embodiments are denoted respectively by the same reference symbols and will not be described any further. Since the development apparatus of the different colors have the same configuration, only the development apparatus of the yellow color (Y) will be described below. This embodiment of development apparatus is adapted to be mounted on an image forming apparatus for use.

In the development apparatus of this embodiment, the anilox roller 32Y and the supply roller 34Y are separated from each other only by a minute gap d and adapted to be entrained by each other to rotate. With this arrangement, it is possible to supply the anilox roller 32Y with an optimal quantity of liquid developer by driving the supply roller 34Y at a rotary speed different from that of the anilox roller 32Y. In this embodiment, the toner particles are subjected to micro-oscillations by applying an AC voltage to the regulation blade 33Y.

When a bias voltage of +300V is applied to the development roller 20Y, a DC bias voltage of equally +300 V is applied to the anilox roller 32Y and the regulation blade 33Y. At this time, an AC voltage of 0 to 600 V of a frequency of 1,500 Hz is simultaneously applied to the regulation blade 33Y that contacts the anilox roller 32Y in order to give micro-oscillations to the toner particles in the liquid developer. While the AC bias voltage may show a rectangular waveform or a sinusoidal waveform, the use of a rectangular waveform is preferable from the viewpoint of effectively achieving micro-oscillations of toner particles.

In this embodiment, an AC voltage as described above is applied to the regulation blade 33Y to give micro-oscillations to the toner particles so as to uniformly disperse the toner particles in the liquid developer. FIGS. 18 and 19 are enlarged schematic illustrations of the contact area of the anilox roller 32Y and the regulation blade 33Y. In FIGS. 18 and 19, C denotes carrier liquid and T denotes toner particles. FIG. 18 is a schematic illustration of the contact area when an AC voltage is applied to the regulation blade 33Y, whereas FIG. 19 is a schematic illustration of the contact area when no AC voltage is applied to the regulation blade 33Y. As seen from FIG. 18, the toner particles in the liquid developer that are found between the anilox roller 32Y and the supply roller 34Y are uniformly dispersed when an AC voltage is applied to the regulation blade 33Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, as shown in FIG. 19, toner particles are unevenly dispersed in the liquid developer and areas that are practically free from toner particles such as the one indicated by A in FIG. 19 locally appear in the liquid developer between the anilox roller 32Y and the regulation blade 33Y when no AC voltage is applied to the regulation blade 33Y. Then, as a result, minute uneven concentrations appear on the image developed on the development roller.

A recycling system is established in the development apparatus 30Y of this embodiment in such a way that the liquid developer compacted by the toner compressing roller 22Y and the liquid developer scraped off by the image bearing member squeezing roller 13Y are recycled from the liquid developer collecting sections 15Y, 24Y, 25Y. Therefore, the toner in the liquid developer fed back to the agitation tank 70Y includes aggregates. The agitation tank 70Y is equipped with an agitation apparatus 75Y and the toner aggregates are partly but not satisfactorily dissolved by the agitation apparatus 75Y. More specifically, when an AC voltage is not applied to the regulation blade 33Y, toner aggregates locally exist in the liquid developer found between the anilox roller 32Y and the regulation blade 33Y as indicated by D in FIG. 19 so that a minute uneven concentration can appear on the image developed on the development roller.

In view of this problem, an AC bias voltage is applied to the liquid developer in the grooves of the anilox roller to dissolve the toner aggregates and uniformly disperse toner particles in the carrier oil in the development apparatus of the embodiment. With this arrangement, no minute uneven concentration appears on the image ultimately developed on the development roller. Then, no uneven image quality occurs to the image ultimately transferred onto a recording medium.

Figure 22:
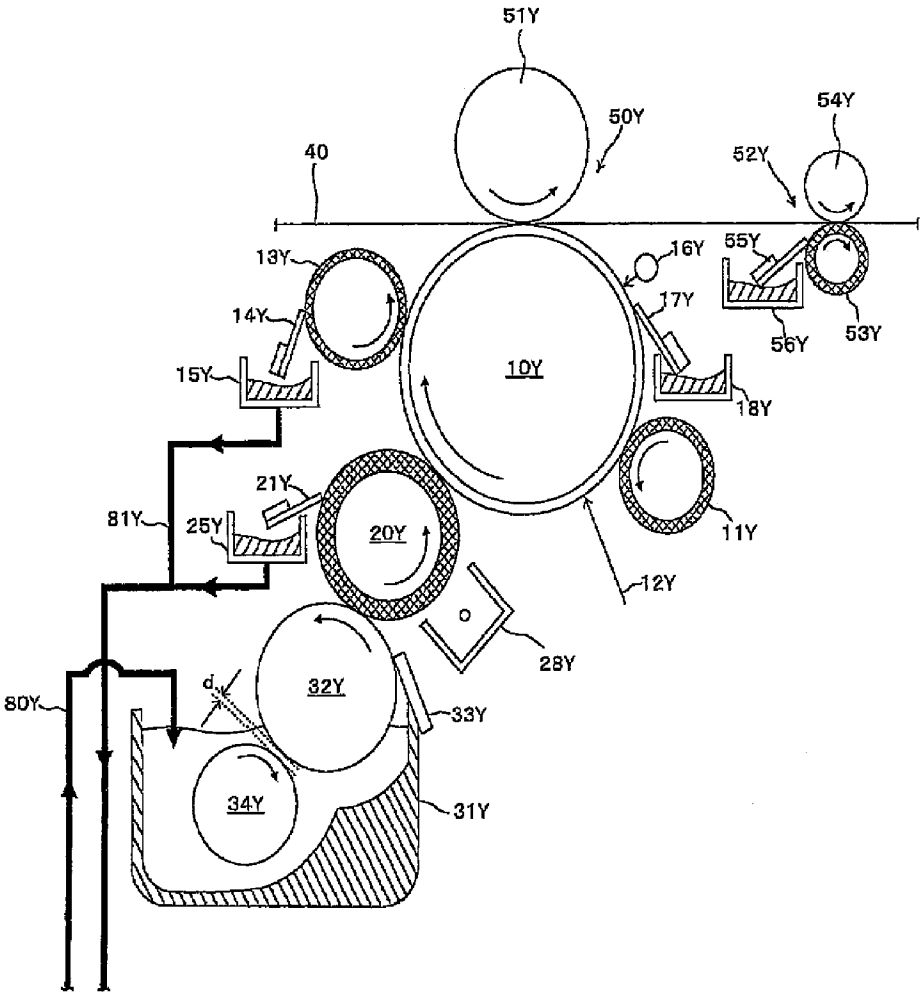
FIG. 22 is a schematic cross sectional view of principal components of one of the development units of another embodiment of development apparatus according to the present invention.

Now, still another embodiment of development apparatus according to the present invention will be described. FIG. 22 is a schematic cross sectional view of principal components of one of the development units of the development apparatus of this embodiment. The components same as or similar to those of the preceding embodiments are denoted respectively by the same reference symbols and will not be described any further. Since the development apparatus of the different colors have the same configuration, only the development apparatus of the yellow color (Y) will be described below. This embodiment of development apparatus is adapted to be mounted on an image forming apparatus for use.

In the development apparatus of this embodiment, the anilox roller 32Y and the supply roller 34Y are separated from each other only by a minute gap d and adapted to be entrained by each other to rotate. With this arrangement, it is possible to supply the anilox roller 32Y with an optimal quantity of liquid developer by driving the supply roller 34Y at a rotary speed different from that of the anilox roller 32Y.

In the development apparatus of this embodiment, a corona charger 28Y is employed to compact toner on the development roller 20Y. It may be required that the carrier concentration in the liquid developer on the development roller 20Y is maintained to a high level depending on the configuration of the image forming apparatus Then, it is advantageous to subject the liquid developer on the development roller 20Y to compaction by means of a corona charger 28Y as in the case of this embodiment. Note that the second developer collecting route 82Y is not necessary in this embodiment.

This embodiment is so arranged that an AC voltage is applied to the regulation blade 33Y in order to give micro-oscillations to toner particles. When a bias voltage of +300 V is applied to the development roller 20Y, a DC bias voltage of equally +300 V is applied to the anilox roller 32Y and the regulation blade 33Y. At this time, an AC voltage of 0 to 600 V of a frequency of 1,500 Hz is simultaneously applied to the regulation blade 33Y that contacts the anilox roller 32Y in order to give micro-oscillations to the toner particles in the liquid developer. While the AC bias voltage may show a rectangular waveform or a sinusoidal waveform, the use of a rectangular waveform is preferable from the viewpoint of effectively achieving micro-oscillations of toner particles.

In this embodiment, an AC voltage as described above is applied to the regulation blade 33Y to give micro-oscillations to the toner particles so as to uniformly disperse the toner particles in the liquid developer. FIGS. 18 and 19 are enlarged schematic illustrations of the contact area of the anilox roller 32Y and the regulation blade 33Y. In FIGS. 18 and 19, C denotes carrier liquid and T denotes toner particles. FIG. 18 is a schematic illustration of the contact area when an AC voltage is applied to the regulation blade 33Y, whereas FIG. 19 is a schematic illustration of the contact area when no AC voltage is applied to the regulation blade 33Y. As seen from FIG. 1B, the toner particles in the liquid developer that are found between the anilox roller 32Y and the supply roller 34Y are uniformly dispersed when an AC voltage is applied to the regulation blade 33Y. Then, as a result, the toner particle concentration of the liquid developer sucked up into the grooves of the anilox roller 32Y becomes uniform and hence no minute uneven concentration appears on the image ultimately developed on the development roller. Then, no uneven image quality occurs to the image ultimately transferred onto a recording medium. To the contrary, toner particles are unevenly dispersed in the liquid developer and areas that are practically free from toner particles such as the one indicated by A in FIG. 19 locally appear in the liquid developer between the anilox roller 32Y and the regulation blade 33Y when no AC voltage is applied to the regulation blade 33Y. Then, as a result, minute uneven concentrations appear on the image developed on the development roller.

A recycling system is established in the development apparatus 30Y of this embodiment in such a way that the liquid developer compacted by the toner compressing roller 22Y and the liquid developer scraped off by the image bearing member squeezing roller 13Y are recycled from the liquid developer collecting sections 15Y, 24Y, 25Y. Therefore, the toner in the liquid developer fed back to the agitation tank 70Y includes aggregates. The agitation tank 70Y is equipped with an agitation apparatus 75Y and the toner aggregates are partly but not satisfactorily dissolved by the agitation apparatus 75Y. More specifically, when an AC voltage is not applied to the regulation blade 33Y, toner aggregates locally exist in the liquid developer found between the anilox roller 32Y and the regulation blade 33Y as indicated by D in FIG. 19 so that a minute uneven concentration can appear on the image developed on the development roller.

In view of this problem, an AC voltage is applied to the liquid developer in the grooves of the anilox roller to dissolve the toner aggregates and uniformly disperse toner particles in the carrier oil. With this arrangement, no minute uneven concentration appears on the image ultimately developed on the development roller. Then, no uneven image quality occurs to the image ultimately transferred onto a recording medium.

What is claimed is:

1. A development apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller; and a supply roller arranged in a developer container for containing the liquid developer and held in contact with the anilox roller to supply the liquid developer to the anilox roller, wherein the anilox roller is held in contact with and pressed against the development roller, a bias voltage is applied to the development roller, and an AC voltage is applied to the supply roller.

2. The apparatus according to claim 1, wherein a bias voltage is applied to the anilox roller that is the same as the bias voltage that is applied to the development roller, and a surface of the supply roller is prepared by using an elastic member.

3. The apparatus according to claim 1, further comprising a toner compressing roller, wherein a bias voltage higher than the bias voltage that is applied to the development roller, and having a same polarity as a polarity of an electric charge of a toner that is supplied by the anilox roller, is applied to the toner compressing roller.

4. A development apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller; and a regulation blade held in contact with the anilox roller to regulate the liquid developer on the anilox roller, wherein the anilox roller is held in contact with and pressed against the development roller, a bias voltage is applied to the development roller, and an AC voltage is applied to the regulation blade.

5. The apparatus according to claim 4, wherein a bias voltage is applied to the anilox roller that is the same as the bias voltage that is applied to the development roller, and the regulation blade is an elastic blade formed by covering a surface with an elastic member.

6. The apparatus according to claim 1 or 4, wherein the AC voltage is the sum of a DC voltage component and an AC voltage component.

7. The apparatus according to claim 6, wherein the DC voltage component is in an amount equal to the bias voltage applied to the development roller.

8. The apparatus according to claim 6, wherein the AC voltage shows a rectangular waveform.

9. An image forming apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller; and a supply roller arranged in a developer container for containing the liquid developer and held in contact with the anilox roller to supply the liquid developer to the anilox roller, wherein the anilox roller is held in contact with and pressed against the development roller, a bias voltage is applied to the development roller, and an AC voltage is applied to the supply roller.

10. An image forming apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller; and a regulation blade held in contact with the anilox roller to regulate the liquid developer on the anilox roller, wherein the anilox roller is held in contact with and pressed against the development roller, a bias voltage is applied to the development roller, and an AC voltage is applied to the regulation blade.

11. The apparatus according to claim 9 or 10, wherein the AC voltage is the sum of a DC voltage component and an AC voltage component.

12. The apparatus according to claim 11, wherein the DC voltage component is in an amount equal to the bias voltage applied to the development roller.

13. The apparatus according to claim 11, wherein the AC voltage shows a rectangular waveform.

14. An image forming apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller;

a supply roller arranged in a developer container for containing the liquid developer and held in contact with the anilox roller to supply the liquid developer to the anilox roller; and a recycling mechanism for removing the excessive liquid developer from the image bearing member and/or the development roller and recycling the removed liquid developer to the developer container, wherein the anilox roller is held in contact with and pressed against the development roller, a bias voltage is applied to the development roller, and an AC voltage is applied to the supply roller.

15. The apparatus according to claim 14, wherein the supply roller and the anilox roller are driven to rotate in the same direction in a nip section.

16. The apparatus according to claim 14, wherein the AC voltage is the sum of a DC voltage component and an AC voltage component.

17. An image forming apparatus, comprising:

a development roller for developing a latent image formed on an image bearing member by means of a liquid developer;

an anilox roller for supplying the liquid developer to the development roller, grooves of undulations of an anilox pattern being formed on a surface of the anilox roller;

a supply roller arranged in a developer container for containing the liquid developer and held in contact with the anilox roller to supply the liquid developer to the anilox roller;

a regulation blade for regulating the liquid developer on the anilox roller; and a recycling mechanism for removing the excessive liquid developer from the image bearing member and the development roller and recycling the removed liquid developer to the developer container, a bias voltage being applied to the development roller, and an AC voltage being applied to the regulation blade.

18. The apparatus according to claim 17, wherein the supply roller and the anilox roller are driven to rotate in the same direction in a nip section.

19. The apparatus according to claim 17, wherein the AC voltage is the sum of a DC voltage component and an AC voltage component.

* * * * *